US011583086B2

(12) United States Patent
Lee

(10) Patent No.: US 11,583,086 B2
(45) Date of Patent: Feb. 21, 2023

(54) FUNCTIONAL LEGLESS CHAIR

(71) Applicant: ABLUE Co., Ltd., Gyeonggi-do (KR)

(72) Inventor: Myung Wook Lee, Gyeonggi-do (KR)

(73) Assignee: ABLUE Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/462,104

(22) Filed: Aug. 31, 2021

(65) Prior Publication Data

US 2022/0378209 A1 Dec. 1, 2022

(30) Foreign Application Priority Data

May 26, 2021 (KR) ..... 10-2021-0067623

(51) Int. Cl.

| | |
|---|---|
| ***A47C 1/14*** | (2006.01) |
| ***A47C 3/16*** | (2006.01) |
| ***A47C 7/02*** | (2006.01) |
| ***A47C 7/74*** | (2006.01) |
| ***A47C 3/12*** | (2006.01) |
| ***A47C 3/02*** | (2006.01) |
| ***A47C 3/029*** | (2006.01) |

(52) U.S. Cl.

CPC ..... *A47C 3/16* (2013.01); *A47C 1/146* (2013.01); *A47C 3/02* (2013.01); *A47C 3/029* (2013.01); *A47C 3/12* (2013.01); *A47C 7/021* (2013.01); *A47C 7/0213* (2018.08); *A47C 7/748* (2013.01)

(58) Field of Classification Search

CPC ..... A47C 1/146; A47C 3/02; A47C 3/029; A47C 3/12; A47C 3/16; A47C 7/023; A47C 7/0213; A47C 7/021; A47C 7/748

USPC ..... 297/180.12, 228.13, 219.1, 233, 272.1, 297/452.11, 452.12, 452.14, 452.21, 297/452.25, 452.26, 452.3, 452.31, 297/452.32

See application file for complete search history.

(56) References Cited

U.S. PATENT DOCUMENTS

| | | | | | |
|---|---|---|---|---|---|
| D142,800 | S | * | 11/1945 | Watson | 297/452.33 |
| D181,270 | S | * | 10/1957 | Barecki et al. | D6/375 |
| D182,063 | S | * | 2/1958 | Dean et al. | 297/DIG. 2 |
| 3,014,762 | A | * | 12/1961 | Mauser | A47C 31/02 297/445.1 |
| 3,138,404 | A | * | 6/1964 | Newton | B60N 2/7035 297/DIG. 2 |
| 3,740,096 | A | * | 6/1973 | Bridger | A47C 7/029 297/452.33 |
| 3,749,442 | A | * | 7/1973 | Berg | A47C 7/14 297/312 |
| 4,088,367 | A | * | 5/1978 | Atkinson | A47C 5/12 297/DIG. 2 |
| 4,418,958 | A | * | 12/1983 | Watkin | A47C 3/12 297/DIG. 2 |

(Continued)

FOREIGN PATENT DOCUMENTS

| | | | | |
|---|---|---|---|---|
| JP | 2020168583 | A * | 10/2020 | A47C 7/021 |
| KR | 10-2012-0061581 | A | 6/2012 | |

(Continued)

*Primary Examiner* — Robert Canfield

(74) *Attorney, Agent, or Firm* — The PL Law Group, PLLC

(57) ABSTRACT

A functional sitting chair according to an embodiment of the present disclosure effectively distributes the user's body pressure even when the user sits for a long time, stably supports the user's waist and back, provides a heating function, and maintains great comfort by effectively circulating air through a pattern formed on the cushion.

19 Claims, 13 Drawing Sheets

(56) References Cited

U.S. PATENT DOCUMENTS 4,628,188 A * 12/1986 Andreasson ..... A47C 7/748 219/217
4,828,325 A * 5/1989 Brooks ..... B29C 44/1204 264/45.2
D307,221 S * 4/1990 Mudge ..... 297/DIG. 2
5,887,951 A * 3/1999 Willingham ..... A47C 7/029 297/258.1
6,550,858 B1 * 4/2003 Grohs ..... B60N 2/4256 297/452.33
7,607,738 B2 * 10/2009 Gregory ..... A47C 7/029 297/452.23
8,485,596 B1 * 7/2013 Martin ..... A47C 7/748 2/84
D727,077 S * 4/2015 Ye ..... D6/716
D870,481 S * 12/2019 Lee ..... D6/375
2004/0245820 A1 * 12/2004 Sorrenti ..... A47C 7/029 297/256.16
2007/0152479 A1 * 7/2007 Howman ..... A47C 7/021 297/180.11
2011/0277246 A1 * 11/2011 Willingham ..... A47C 9/002 5/653
2012/0068507 A1 * 3/2012 Debevec ..... A47D 1/103 297/250.1
2012/0181840 A1 * 7/2012 Leone ..... A47C 7/46 297/452.3
2012/0223556 A1 * 9/2012 Cheng ..... B29C 33/0044 297/219.1
2014/0077573 A1 * 3/2014 Schneider ..... A47C 5/12 297/452.14
2014/0183924 A1 * 7/2014 Cvek ..... A47C 7/282 297/452.21
2015/0015042 A1 * 1/2015 Willingham ..... A47C 7/144 297/284.7
2015/0150379 A1 * 6/2015 Muraguchi ..... A47C 7/40 297/445.1
2020/0008580 A1 * 1/2020 Kanda ..... A61F 5/01
2020/0022497 A1 * 1/2020 Seo ..... A47C 7/407

FOREIGN PATENT DOCUMENTS

KR 10-1598473 B1 2/2016
WO WO-2015080231 A1 * 6/2015 ..... A47C 7/021
WO WO-2019191657 A1 * 10/2019 ..... A47C 3/029

* cited by examiner

Prior Art 3021
3023
3022
3221
3211
3212
3216
3511
3521
3512
3513
3521
3512
3513
3521
3512
3513

FUNCTIONAL LEGLESS CHAIR

CROSS-REFERENCE TO RELATED APPLICATION(S)

This application claims priority to Korean Patent Application No. 10-2021-0067623 filed on May 26, 2021, in the Korean Intellectual Property Office (KIPO), the entire disclosure of which is incorporated by reference herein.

BACKGROUND

This disclosure pertains to a legless chair. More specifically, it pertains to a functional sitting chair that offers comfort while stably supporting a user's right posture when seated.

A chair refers to furniture designed for a user to sit on. Most people as well as students and office workers sit in a chair to study or work for a considerable amount of time in their daily lives, which would cause their upper bodies to lean forward, making them fall off the backrest of the chair and for this reason, even if they sit on the special chair for postural management, there is no stable support for the lower back or back and sitting on a chair for a long time can create problems such as backache or back pain and lose postural control.

For this, many posture correction chairs have been introduced that help the users maintain their lumbar spine in a comfortable and good posture during rest or work, but there are not many chairs that can actively respond to users' front-to-back movements when the upper body is bent forward during work.

Looking at the types of chairs for posture correction up until now, it can be largely categorized into chairs with a focus on the backrest, chairs with a focus on the seat, and chairs of a complex form and among them, there is a strong trend toward the products focusing on the backrest structure.

Korean Patent Publication No. 10-2012-0061581 introduces a legless chair that supports the lumbar spine. The sitting chair generally comprises a seat and a back rest, and refers to a chair without legs provided so that the seat is spaced apart from a floor surface. However, still a problem exists in such a way that the user's waist and back cannot be reliably supported as the upper body is tilted when the user is seated and works.

Republic of Korea Patent No. 10-1598473 introduces a sitting chair that naturally supports the user's waist and back by using the principle of a lever as the user's upper body tilts. It is effective in supporting the waist and back stably, but it may be difficult to dissipate heat and circulate air properly when sitting for a long time. Besides, it is not equipped with a heating function for winter use, and has a structure that makes it difficult to attach and detach a cushion pad attached to a chair.

Nevertheless, the seat portion that touches the user's buttocks is curved and can be shaken by tilting left and right when seated. However, depending on the use environment, it is necessary to eliminate the left and right shaking of the legless chair and use it in a fixed state.

Besides, the upper part of the chair that supports the waist and back is not separated into a plurality of parts, and the lower part of the chair that supports the buttocks is not separated into plural. Such being the case, there is a problem in that the body pressure applied to the chair when the user is seated is not distributed in several places.

Besides, it discloses an angled rib to reinforce the strength of the portion connecting between the waist portion and the hip portion. However, the angled ribs have a problem associated with a shrinkage phenomenon when the chair is injection molded.

This disclosure aims to solve the task that the user can maintain reasonable comfort through smooth heat dissipation and air circulation when seated for a long time.

The task of this disclosure is to resolve by having a heating function.

The task of this disclosure aims to solve the phenomenal problem of shaking left and right when the user is seated.

The task of this disclosure is to improve the distribution of body pressure applied to a chair when a user is seated.

The task of this disclosure to offer an effective solution to facilitate the attachment and detachment of the cushion and the pad.

The task of this disclosure aims to improve the shrinkage phenomenal problem during injection molding.

In an effort to solve the above-mentioned problems, when the user is seated, a first support for providing support at least a portion of the user's waist portion; a second support part placed in front of the first support part and a lower part of the first support part when the user is seated, and supporting at least a portion of the user's buttocks and both thighs; and a connection support part linking the first support part and the second support part, in which the first support part contains a support coupling part linked to the connection support part to support the user's waist aiming to surround the user's waist; and a plurality of upper support parts extending upward from the support coupling part, in which the second support part contains: a recessed support part in a shape that is recessed in a shape conforming to the user's buttocks; and a plurality of lower support parts extending forward from the depression support part; and providing a functional sitting chair.

Besides, the first support part is inclined forward as it goes up in the support coupling part, the second support part is inclined upward forward in the recessed support part, and the connection support part is linked to the first support part. The second support part is linked to a curved surface protruding rearward such that the first support part and the second support part may rotate in the same direction when the user is seated.

The plurality of upper support parts may contain: a first upper support part extending upward from the support coupling part to support the user's lumbar spine; and a second upper support part and a third upper support part extending upward from the support coupling part and positioned on both sides of the first upper support part, individually. a first incision portion positioned between the first upper support part and the second upper support part to split the first upper support part and the second upper support part; and a second cutout positioned between the first upper support part and the third upper support part to separate the first upper support part and the third upper support part.

The plurality of lower support parts contains a first lower support part and a second lower support part extending forward from the depression support part, and the second support part contains the first lower support part and the second lower part. It may further contain a; a front incision positioned between the support parts to split the first lower support part and the second lower support part.

Nonetheless, the second support portion is a fastening hole part shaped through the depression support part; and a protruding detachable part detachably coupled to the fastening hole part, in which the protruding detachable part protrudes from the rear surface of the second support part when coupled to the fastening hole part.

The fastening hole part comprises: a first fastening hole positioned between one side of the second support part at the center of the second support part in width direction of the second support part; and a second fastening hole positioned between the other side surface of the second support part at the center of the second support part along the width direction of the second support part; a first protrusion leg detachably coupled to the first fastening hole; and a second protruding leg detachably coupled to the second fastening hole, in which the first protruding leg and the second protruding leg are individually coupled to the first fastening hole and the second fastening hole and it may protrude further than the rear surface of the support part 2.

Nevertheless, the functional sitting chair is a hip center hole shaped through the depression support part; a heating part for heating at least a portion of the second support unit; and a cable for supplying power to the heating part.

The cable may be inserted into the front surface of the second support part from the rear surface of the second support part through the hip center hole to be connected electrically to the heating part.

That is, the depression support part is shaped by protruding upward in a direction from the hip center hole toward the connection support part in a region positioned between the hip center hole and the connection support part among the depression support parts. It comprises a protrusion and depression, and the cable may be inserted through a separation space shaped under the protrusion and depression to be electrically linked to the heating part.

Furthermore, the connection support portion is shaped through the connection support portion, the first curved hole and the second curved hole is aligned in parallel in the left and right direction of the connection support portion; a central rib positioned between the first curved hole and the second curved hole; a first rib part positioned between one of the outer surfaces of the connection support part and the first curved hole to link the first support part and the second support part; and a second rib part positioned between the other side of the outer surface of the connection support part and the second curved hole to connect the first support part and the second support part, in which the first rib part is the first curved surface; at least a portion of the first rib portion is provided in a wavy shape in a direction from the hole to the one side, and at least a portion of the second rib portion is wavy in a direction from the second curved hole to the other side surface may be provided in the shape.

Furthermore, the functional legless chair further contains an upper cushion part detachably coupled to the first support part; and a lower cushion part detachably coupled to the second support part.

The upper cushion portion is a first cushion detachably coupled to the first upper support part; a second cushion detachably coupled to the second upper support part; and a third cushion detachably coupled to the third upper support part, in which the lower cushion part contains: a first pad detachably coupled to a position contacting one of the user's buttocks; and a second pad detachably coupled to a position contacting the other one of the user's buttocks.

The first upper support part, the second upper support part, and the third upper support part contain a first through-hole, a second through-hole, and a third through-hole shaped through individually, and The second support portion contains a first coupling hole and a second coupling hole shaped through the second support portion, and the first cushion is a first cushion hook supplied at a position facing the first through hole; contains and, the second cushion contains a second cushion hook provided at a position facing the second through hole, and the third cushion contains a third cushion hook supplied at a position facing the third through hole; and a first pad hook, in which the first pad is supplied at a position facing the first coupling hole, and the second pad is a second pad supplied at a position facing the second coupling hole; and a hook, in which the first cushion hook, the second cushion hook, the third cushion hook, the first pad hook, and the second pad hook each contain the first through hole, the second through hole, and the third through hole, the first coupling hole, and the second coupling hole may be inserted into the hook coupling.

The upper cushion part contains an upper cushion vent part in which a part of the surface contacting the user's waist is recessed in a groove shape to form a path for air movement, and the lower cushion part is the user's buttocks part, a portion of the surface contacting the recessed groove shape may contain a lower cushion vent to form a path for air movement.

The first cushion, the second cushion and the third cushion are each recessed in a groove shape in a portion of the surface contacting the user's waist to form a path through which air circulates upward. It may contain a first upper channel, a second upper channel, and a third upper channel.

The second support portion is positioned closer to one side of both sides of the second support portion than the other side, a first hip hole shaped through the second support portion; and a second hip hole in which the other side of both sides of the second support part is placed closer than one side and is formed through the second support part, in which the first pad is supplied to face the first hip hole, contains; a first pad through hole shaped through the first pad, in which the second pad is supplied to face the second hip hole, a second pad through hole shaped through the first pad; contains and the first pad communicates with the first pad through hole and the first hip hole, and a part of the surface contacting the one of the buttocks is recessed in a groove shape to circulate air toward the front, and a first communication channel forming. It may contain a second communication channel forming a path through which air is circulated toward the front.

Hip center hole shaped through the recessed support part; further comprising, some of the air flowed through the hip center hole may move toward the front incision through the first pad and the second pad.

The first pad contains at least one first front channel that is spaced apart from each other on at least one side of both sides of the first communication channel and is recessed into a groove shape, and the second pad contains the at least one first front channel that is spaced apart from each other on at least one side of both sides of the second communication channel and is recessed into a groove shape.

Moreover, each of the first front channel and the second front channel may be supplied in a curved shape.

In the meantime, the connection support part is shaped through the connection support part, and the connection support part contains a first curved hole and a second curved hole which are aligned side by side in the left and right directions, and the second support part reinforces the depression. Hip center hole formed through the part; a first hip hole in which one side of both sides of the second support part is positioned closer than the other side in front of the hip center hole and is shaped through the second support part; and a second hip hole in which the other side of both sides of the second support part is placed closer than one side in front of the hip center hole and is shaped through the second support part.

The first support part, the second support part, and the connection support part are supplied with an elastic material and may be integrally injection molded.

The present disclosure can maintain comfort for users, through smooth heat dissipation and air circulation, even when seated for a long time.

The present disclosure may provide a heating function.

The present disclosure prevents the user from moving from side to side when seated.

The present disclosure can improve the distribution of body pressure applied to the chair when the user is seated.

The present disclosure can facilitate the attachment and detachment of the cushion and the pad.

The present disclosure can improve the shrinkage phenomenon occurring during injection molding.

BRIEF DESCRIPTION OF THE DRAWINGS

FIGS. 8A and 8B illustrate the air movement path formed in the functional sitting chair.

DETAILED DESCRIPTION

Hereinafter, with reference to the attached drawings, preferred embodiment of the present disclosure will be described in detail. The configuration or control method of the device to be described below is just for describing the embodiment of the present disclosure and not for limiting the scope of the present disclosure, and the same reference numbers used throughout the specification indicate the same components.

Specific terms used in the present specification are only for convenience of description and are not used to limit the embodiment.

For instance, expressions such as "sameness" and "same" not only indicate a strictly identical state, but also indicate a state wherein a tolerance or a difference in the degree of obtaining the same function exists.

For instance, expressions describing relative or absolute positioning such as "in any direction", "along a certain direction", "in parallel", "vertically", "central", "concentric" or "coaxial" are not only strictly indicative of such an arrangement, but also indicates a state wherein the relative displacement is carried out with a tolerance or an angle or distance that obtains the same function.

The use of terms such as 'first, second, third' before the components mentioned hereto below is only intended to clear up confusion of the components referred to, and the order, importance, or has nothing to do with master-slave relations, etc. For instance, an invention including only the second component without the first component can also be implemented.

The singular representation used in this specification contains the plural expression unless the context explicitly means otherwise.

Hips and buttocks used in this specification are in medical terms, respectively, Illium or. The buttocks refer to the upper part of the hip region that joins the pelvis, and the buttocks are the lower part of the hip region referring to the part with muscles touching the floor when sitting. That is, the part of the pants that touches the bottom of the buttocks.

The hip region refers to the convex part of the flesh on both sides of the lower back of the waist and upper thighs. Therefore, the upper part of the hip region is the hips, and the lower part is the buttocks.

It may mean otherwise in English culture, but in the present specification, the hips are medically equivalent to the Illium, and the buttocks are body parts called Gluteus maximus. Besides, the buttocks of the human body should be used in the plural form because there are the left buttocks and the right buttocks, but in the present specification, unless expressly describing one side of the buttocks, such as either one of the buttocks or the other, it refers to both sides.

Figure 1:
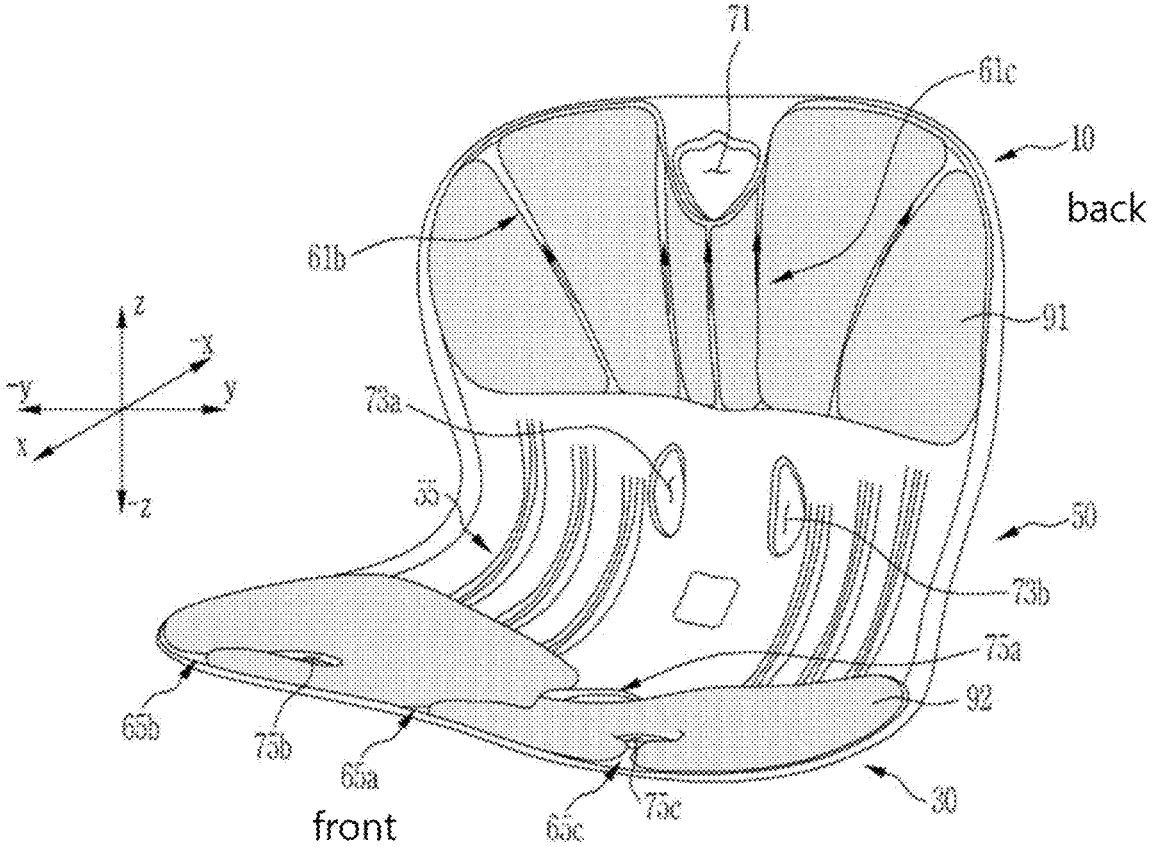
FIG. 1 is an example of a conventional functional legless chair.

FIG. 1 illustrates an example of a conventional functional legless chair (1). Referring to FIG. 1, the functional sitting chair (1) contains a hip support part (30) wherein thighs and buttocks are placed when a user is seated, a waist support (10) wherein a back portion is placed when the user is seated, and the hip connects the support part (30) and the waist support part (10) in a curved surface, and contains a connection support part (50) wherein a part of the user's hips and waist is placed.

The lumbar support part (10) may contain a lumbar support part air hole (71) formed through the lumbar support part (10) for air circulation when the user is seated.

The connection support part (50) may also contain connection support part air holes (73*a*, 73*b*) established through the connection support part (50) for air circulation when the user is seated. The first air hole (73*a*) of the connecting support part and the second air hole (73*b*) of the connecting support part may be arranged parallel to the height direction of the functional seating chair (1) and may be positioned below the lumbar air hole (71).

The hip support part (30) may also contain a plurality of hip support part air holes (75*a*, 75*b*, 75*c*) established through the hip support part (30) for air circulation when the user is seated.

Since the waist support part (10) and the hip support part (30) are parts that can have direct contact with the user's waist and buttocks, the functional legless chair (1) is a cushion for the user's comfortable seating and support and thus it may further contain parts (91, 92).

The cushion parts (91) and (92) may comprise a waist cushion (91) cut along the outline of the waist support part (10) and a hip cushion (92) cut along the outline of the hip support part (30).

The waist cushion (91) may be partially incised for the waist cushion (91) and the waist support air hole (71) to avoid overlapping with each other where the waist support air hole (71) is positioned. This is for smooth air circulation.

The hip cushion (92) corresponds to the plurality of hip support air holes (975*a*, 75*b*, 75*c*) respectively, and a portion of the hip cushion (92) may be incised for the plurality of hip support air channels (65*a*, 65*b*, 65*c*) and the hip cushion (92) to avoid overlapping.

The lumbar cushion (91) may contain a lumbar central channel part (61*a*) positioned between the lumbar air holes (73*a*, 73*b*) and the lumbar air holes (71) in the direction of the lumbar air holes (73*a*, 73*b*) to form a path through which air passes. It may also contain a channel part (61*b*) around the waist support provided in the form of a groove wherein the waist cushion (91) is recessed in the direction of both sides of the waist support air holes (73*a*, 73*b*).

Moreover, the hip cushion (92) may contain a first air channel (65*a*) of the hip support part to flow air forward from the first air hole (75*a*) of the hip support part, and a second air hole (75*b*) of the hip support part, and a hip support part second air channel (65*b*) and a hip support part third air channel (65*c*) to flow air forward in the hip support part third air hole (75*c*), respectively.

The waist support center channel part (61*a*) and the waist support surrounding channel part (61*b*) are not shaped as separate members, but may be shaped by recessing a part of the waist cushion (91). That is, the waist cushion (91) may be a pattern shaped by depression.

Likewise, the plurality of air channels (65*a*, 65*b*, 65*c*) of the hip support part may not be shaped as separate members, but a part of the hip cushion (92) may be recessed. That is, the hip cushion (92) may be a pattern shaped by depression.

However, except for the waist support air hole (71) in the direction toward the upper part of the functional legless chair (1) along the waist support (10), the waist support (10) is incised not to contain part wherein air can move. Furthermore, since the waist cushion (91) attached to the waist support part (10) is also integrally shaped and attached to the waist support part (10), except for the waist support part central channel part (61*a*) and the waist support part surrounding channel part (61*b*), there is no structure for ventilating or introducing air.

Likewise, except for multiple hip air holes (75*a*, 75*b*, 75*c*) along the hip support (30), the hip support part 30 in direction toward the front part of the functional sitting chair (1), the hip support unit (30) is incised and does not contain a part through which air can move. Furthermore, since the hip cushion (92) attached to the hip support part (30) is also integrally shaped and attached to the hip support part (30), and thus except for the plurality of hip support part air channels (65*a*, 65*b*, 65*c*), there is no structure for air ventilation or inlet.

Therefore, the conventional functional sitting chair (1) can support the user's waist and back stably, but there are limitations to the construction of air circulation due to insufficient air circulation in waist cushion (91), the hip cushion (92), the waist support part (10) and the hip support part (30) as there is a limit to dissipate heat due to the user's body heat during long-term use.

And, there can be a problem associated with the absence of a separate incision on the hip support (30) or the waist support (10) and thereby may not disperse the force applied to the waist support (10) and the hip support (30) by the user when seated.

Concurrently, the connection support (50) may contain a plurality of curved ribs (55) to reinforce the weak strength of the connection support (50). The plurality of curved ribs (55) may be shaped by folding a part of the connection support (50), which is not a separate member but into an angular crease shape. However, the section of the curved rib (55) positioned on the connection support (50) cut in the width direction of the functional sitting chair (1) may be an angled rib in the V shape. Furthermore, the plurality of curved ribs (55) may be formed to extend from the hip support (30) to the waist support (10).

However, the curved ribs (55) with angled sections do not take into account the manufacturing method of functional sitting chairs (1) formed integrally except for cushions. In general, conventional functional sitting chairs (1) are formed of polymer material, and for this purpose, an injection molding method may be primarily used. In this case, since stress is concentrated on the angled curved ribs and is prone to shrinkage deformation, there is a possibility that it may not be made as the intended design.

Besides, the waist cushion (91) and the hip cushion (92) may be fixedly coupled to the above waist support (10) and the hip support (30), respectively. Therefore, it is difficult to separate the waist cushion (91) and the hip cushion (92) once attached, which can cause considerable inconvenience to users who want to properly clean the cushions (91, 92).

Besides, the conventional functional sitting chair 1 does not have a useful heating function in consideration of a cold environment.

Besides, the hip support part 30 is not a flat shape based on the width direction of the functional legless chair (1), but rather a recessed shape gently curved downward. Therefore, depending on the material of the floor surface using the functional seating chair (1), the functional seating chair (1) may not be fixed to the right and left but may shake.

Figure 2B:
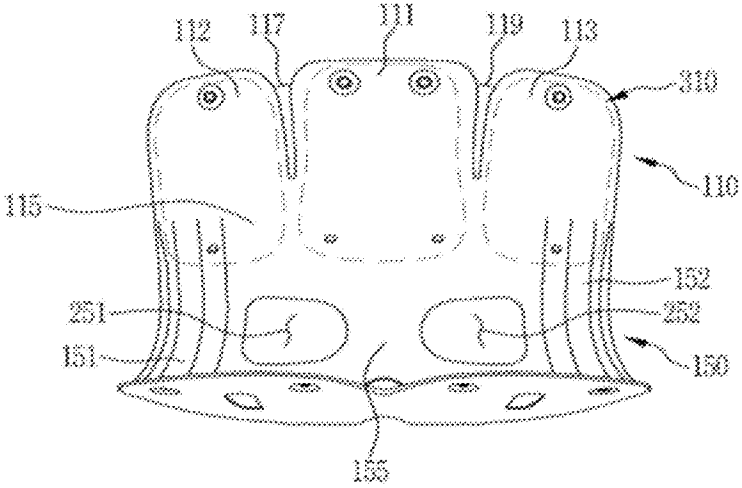
FIGS. 2A-2C illustrate embodiments of the functional legless chair described in the present disclosure.
Figure 2C:
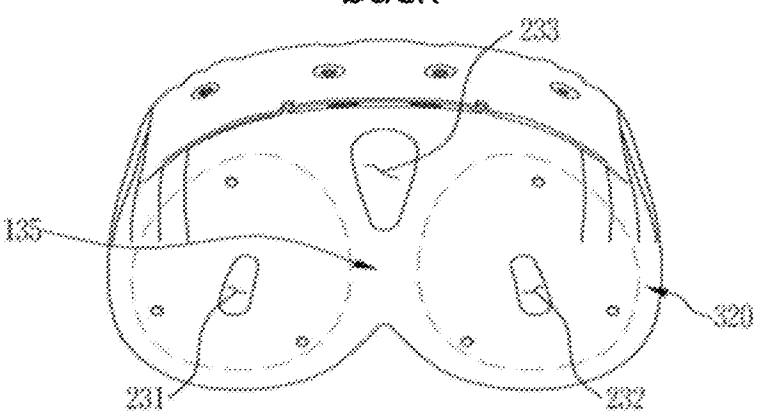
Figure 2A:
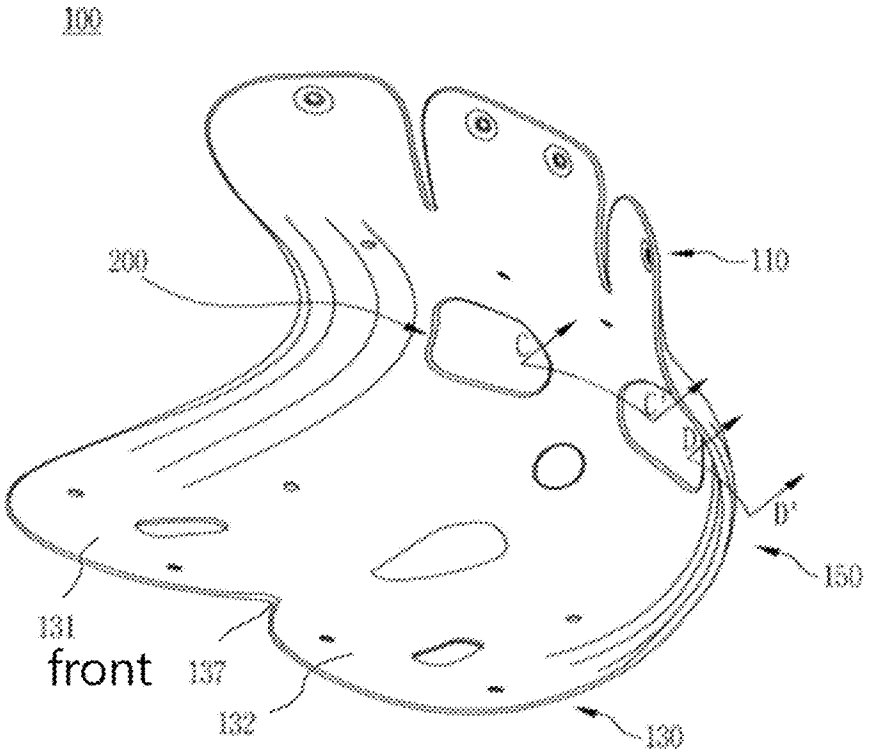

With reference to FIG. 2A, the functional legless chair (100) described in the present disclosure contains a first support unit (110) that supports at least a part of a user's waist when the user is seated, and the user a second support part (130) positioned in front of the first support part (110) and below the first support part (110) to support at least a part of the user's buttocks and thighs when seated, and a connection support part (150) linking the first support part (110) and the second support part (130) altogether.

In the present specification of the functional legless chair (100), the direction wherein the user sits are the front, the rear direction of the second support part (130) is the rear, and both sides or left and right directions mean the width of the functional legless chair (100) direction.

The first support (110), the second support (130) and the connection support (150) may be provided by a flexible elastic material to support the waist and the buttocks. Besides, different parts of the first support part (110), the second support part (130), and the connection support part (150) may be integrally formed from the time of manufacture, rather than being combined into one.

That is, to this end, the material of the functional sitting chair (100) may be a polymer material. Furthermore, the functional legless chair (100) may be manufactured by injection molding.

With reference to FIGS. 2B and 2C, the first support (110) may contain a supporting part (115) linked to the connecting part (150) to surround the user's waist, and a plurality of upper support parts (111, 112, 113) extending upward from the supporting part (115).

The support coupling part (115) is a member of a single curved shape and can be distinguished from the connection support part (150) and the plurality of upper support parts (111, 112, 113) separated in a split form by a plurality of open section. When the user is seated, the support coupling part (115) can face the user's buttocks and waist, or a lower portion of the waist. Furthermore, the support coupling part (115) may partially contact the lower portion of the upper cushion part (310) to be described later.

The plurality of upper support parts (111, 112, 113) may be provided with the upper edge in the curved shape. This is in consideration of user safety.

Moreover, the second support part (130) has a depression support part (135) in a shape corresponding to the user's buttocks, and a plurality of the depression support parts (135) extending forward from the depression support part (135) that may contain lower support parts (131, 132).

The depression support part (135) may be provided in the form of a curved surface contacting the user's buttocks. That is, the depression support part (135) will be provided in a hollowed shape in accordance with the convex shape of both buttocks. This takes into account the shape of the user's body parts.

Since the depression support part (135) is linked to the connection support part (150), it may be provided in a curved shape like the support coupling part (115). Besides, the depression support part (135) may be a part supported touching the floor when the functional legless chair (100) is placed on the floor in the functional legless chair (100).

The first support part (110) may slope toward the front as it goes upward from the support coupling part (115). Furthermore, the connecting support part (150) may be linked to the first support part (110) and the second support part (130) in a curved surface protruding rearward.

That is, if the first support part (110) and the second support part (130) are considered in a plane and the functional sitting chair (100) is viewed from one side, the first support part (110) and the acute angle may be formed between the second support part (130). Through this, at the time of user's seating, if the front part of the second support part (130) is lowered by the user's load, the first support part (110) will rotate toward the user to support the user's waist. Therefore, when the user is seated, the first support part (110) and the second support part (130) will rotate in the same clockwise or counterclockwise direction.

The plurality of upper support parts (111, 112, 113) extend upward from the support coupling part (115) to support the user's waist part, a first upper support part (111), and the support coupling part which extends upward from (115) and may contain a second upper support part (112) and a third upper support part (113) positioned on both sides of the first upper support part (111), respectively.

The first upper support part (111), the second upper support part (112), and the third upper support part (113) may extend upwardly in a split form from the support coupling part 115 from one another.

Accordingly, the first support part (110) positioned between the first upper support part (111) and the second upper support part (112), and the first upper support part (111) and the second upper part a first incision (117) separating the support part (112), and the first upper support part (111) and a second incised part (119) for separating the third upper support part (113) may be further contained.

Similarly, the plurality of lower support parts (131, 132) contain a first lower support part (131) and a second lower support part (132) extending forward from the depression support part (135), and the second support part (130) is provided between the first lower support part (131) and the second lower support part (132) to provide the first lower support part (131) and the second lower support part (132) may further contain an anterior incision (137) for separating.

Besides, the plurality of lower support parts (131, 132) may also be provided with a curved edge of the front end. This is for the sake of user safety.

Figure 4B:
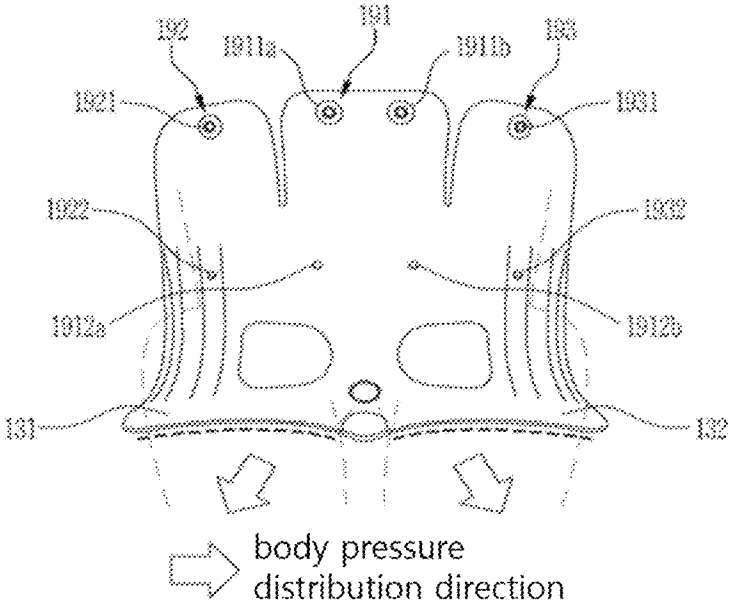
FIGS. 4A and 4B illustrate the distribution of body pressure of the user by the functional sitting chair when the user is seated.
Figure 4A:
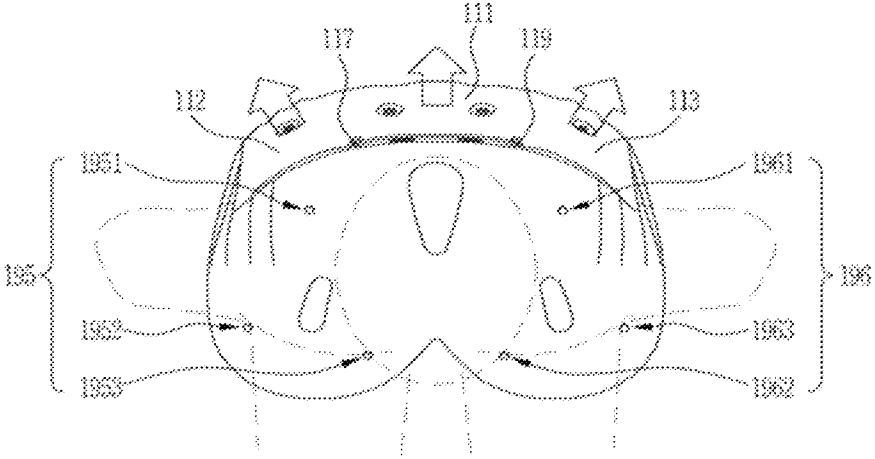

With reference to FIGS. 4A and 4B, this is designed to effectively distribute the user's load through the functional sitting chair (100). When the user is seated, the user's load borne per unit area of the functional legless chair (100) may be referred to as body pressure.

In case the first support part 110 is shaped with a single member, and when the user leans the waist part on the first support part (110), all surfaces of the user's waist part and the first support part (110) will not touch. Accordingly, since the force impacting the first support part (110) by the user's waist will be concentrated only on a part of the first support part (110), may result in deformation and breakage of the first support part (110) and the connection support part (150).

Therefore, rather than supporting the user's waist with a single member, it would be advantageous to distribute the user's body pressure by arranging a plurality of members in the left and right directions to support the user's waist. This is because the plurality of members wraps around the user's waist better than one member, so that the area contacting the user's waist increases.

Similarly, the second support unit may support a portion of the user's buttocks and both thighs. Therefore, unlike the plurality of upper support parts (111, 112, 113) that are divided into three, the plurality of lower support parts (131, 132) are divided into two parts of one thigh positioned in the same direction as the user's one buttocks. support would be effective.

Through this, it is possible to effectively distribute the user's body pressure through the user's buttocks and thighs.

With reference to FIGS. 2B and 2C, the functional legless chair (100) contains the first support part (110), the second support part (130), or the connection support part (150) which may contain an air hole (200) including at least one through hole formed through. This is to prevent the user from sweating because body heat cannot escape due to the close contact between the user and the functional sitting chair (100) during long-term seating. To this end, through the functional legless chair (100), the user's waist, buttocks, or buttocks are used to make contact with external air.

Specifically, the connection support part (150) is shaped through the connection support part (150), and may contain the first curved surface hole (251) and the second curved surface that are placed parallel to the connection support part (150) in the left and right directions.

Besides, the second support part (130) is a hip center hole (233) shaped through the depression support part (135), and the second support part (130) before the hip center hole (233) and one side of both sides is positioned closer than the other side, and the first hip hole (231) shaped through the second support (130), and the second support part (130) before the hip center hole (233) and the other side of both sides is positioned closer than one side and may contain a second hip hole (232) shaped through the second support unit (130).

However, this is just an example, and the number, location, and size of air holes may vary if air is allowed.

Meanwhile, the first support part (110) and the second support part (130) may contain cushion and pad detachable to the plurality of upper support parts (111, 112, 113) and the plurality of lower support parts (131, 132). FIGS. 2B and 2C, the upper cushion part (310) positioned on the first support part (110) and the lower cushion part (320) positioned on the second support part (130) are illustrated with a dotted line. This has been described later.

Figure 3:
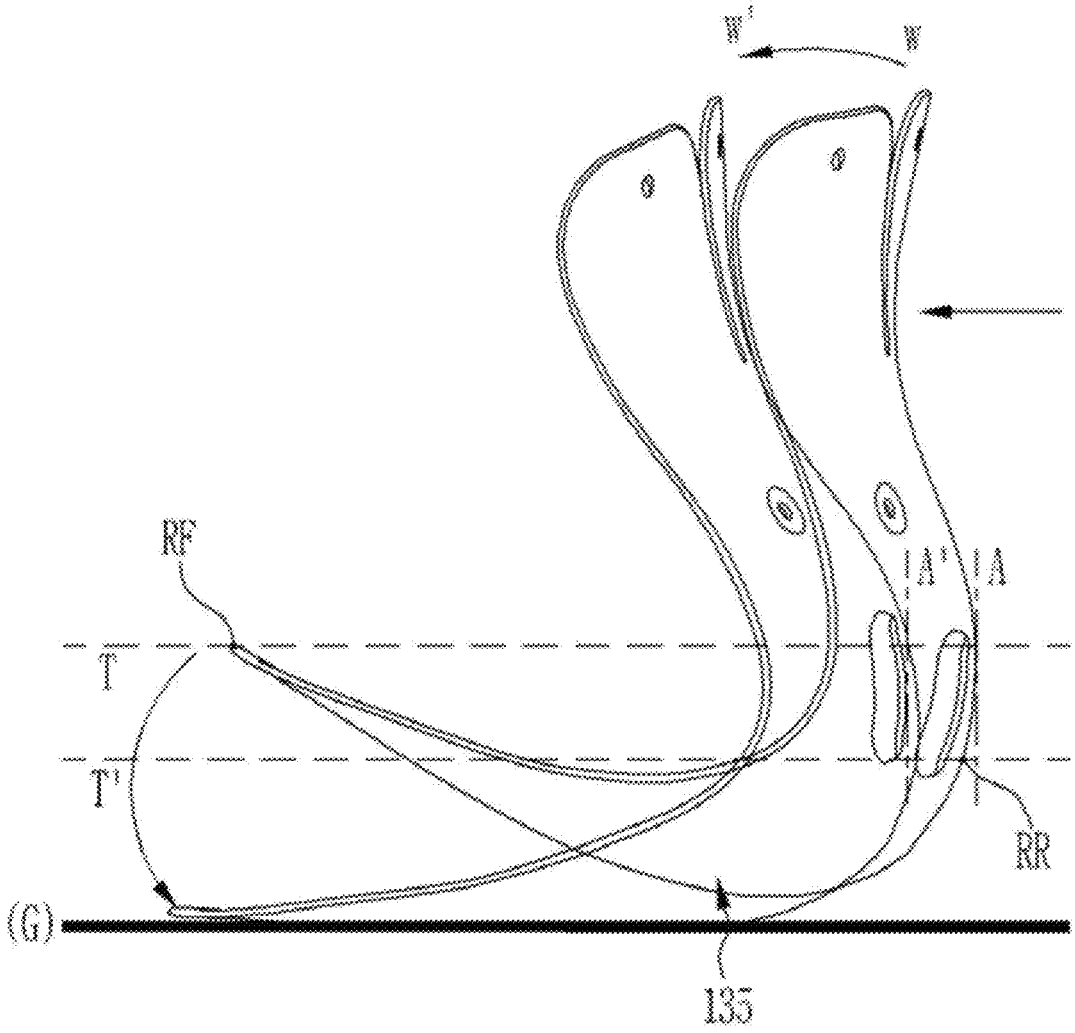
FIG. 3 illustrates the lever principle of the functional legless chair.

With reference to FIG. 3, the first support part (110) may slope forward from the support coupling part (115). Besides, the connecting support part (150) may be linked to the first support part (110) and the second support part (130) in a curved surface protruding rearward.

The depression support part (135) touches the floor surface (G) to support the functional legless chair (100). The bottom surface may be a soft floor surface such as a chair or sofa including a cushion, or a hard floor surface otherwise.

When the user is seated, the front part (RF) of the second support part (130) moves from T to T', and accordingly, the connection support part (150) also moves from the A position to the A' position. Consequently, the upper part of the first support part (110) will also move from W to W' through the connection support part (150).

This may be achieved through rotational movement with a part of the depression support part (135) and the connection support part (150) as a reference point.

That is, when the first support part (110) and the second support part (130) are considered as planes, and the functional legless chair (100) is viewed from one side, the first support part (110) and the acute angle may be formed between the second support portions (130). Through this, when the user is seated, if the front part of the second support part (130) is lowered by the user's load, the first support part (110) will be tilted toward the user to support the user's waist. Accordingly, when viewed from the side as shown in FIG. 3, when the user is seated, the first support part (110) and the second support part (130) will rotate equally in the same clockwise or counterclockwise direction.

The functional legless chair (100) may further contain a through hole shaped through the functional legless chair (100) along with the air hole 200.

With reference to FIG. 4B, it is for coupling with the cushion part (300) provided in the functional sitting chair (100). That is, the first upper support part (111), the second upper support part (112), and the third upper support part (113) each penetrate through a first through hole (191) and a second through hole. (192) and a third through hole (193) may be contained. Besides, the second support part (130) may contain a first coupling hole (195) and a second coupling hole (196) formed through the second support part (130).

Each of the first through hole (191), the second through hole (192), the third through hole (193), the first coupling hole (195) and the second coupling hole (196) and the number may be at least one or more.

For instance, FIG. 4B illustrates two upper first through-holes (1911*a* and 1911*b*) formed through the first upper support part (111). And a first cushion (311) (refer to FIG. 7A and FIG. 7B) is coupled with the two upper first through holes (1911*a* and 1911*b*) in a part positioned below the first upper support part (111) among the support coupling parts (115). It illustrates two lower first through-holes (1912*a* and 1912*b*) for the purpose.

Besides, FIG. 4B illustrates the second upper support part (112) of the upper second through-hole (1921) shaped through the second upper support part (112) and the support coupling part (115), the lower second through hole (1922) is shown in the portion positioned below. This is intended to couple the second cushion (312 see FIG. 7A and FIG. 7B) to the second upper support part (112). And, FIG. 4B illustrates the third upper support part (113) of the upper third through-hole (1931) shaped through the third upper support part (113) and the support coupling part (115). The lower third through hole (1932) is illustrated in the positioned part. This is intended to couple the third cushion (313 refer to FIG. 7A and FIG. 7B) to the second upper support part (112).

This is just an example, and the position, number, and size of the through-holes may be changed without restraint.

That is, the lower first through holes (1912*a*, 1912*b*), the lower second through holes (1922), and the lower third through holes (1932) may also be positioned in the above plurality upper support parts (111, 112, 112) rather than the support coupling part (115).

With reference to FIG. 4A, the second support part (130) may contain a first coupling hole (195) and a second coupling hole (196) shaped through the second support part (130). The first coupling hole (195) is for coupling the first pad (321, refer to FIG. 7A and FIG. 7B) to the first lower support part and a part of the depression support part (135). Besides, the second coupling hole (196) is intended to combine the second pad (322, refer to FIG. 7A and FIG. 7B) to the second lower support part and another part of the depression support part (135).

As an example of the first coupling hole (195, FIG. 4A) illustrates three first coupling holes (1951, 1952, 1953) to the left of the depression support part (135) and the first lower support. It is shown positioned in part (131). Besides, as an example of the second coupling hole (196, FIG. 4A) illustrates three second coupling holes (1961, 1962, 1963) to the right of the depression support part (135) and the second lower support part (132) is illustrated.

Figure 5B:
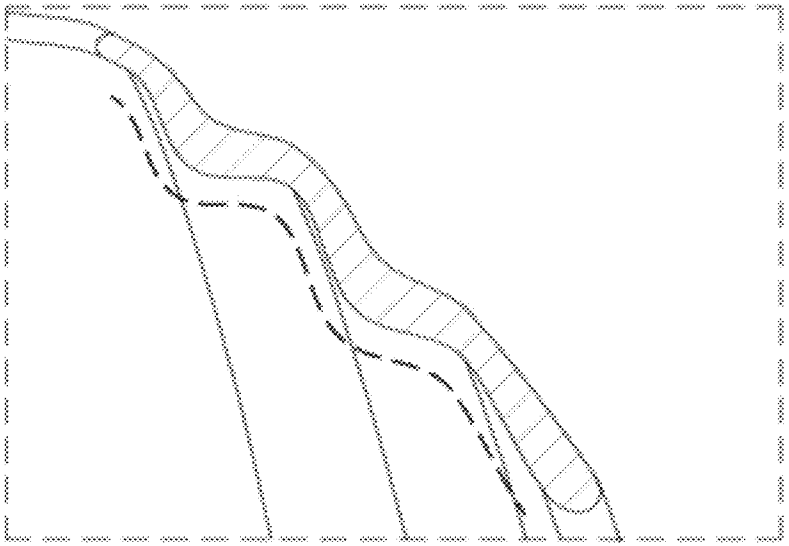
FIGS. 5A and 5B illustrate a partial cross-section of the functional legless chair.
Figure 5A:
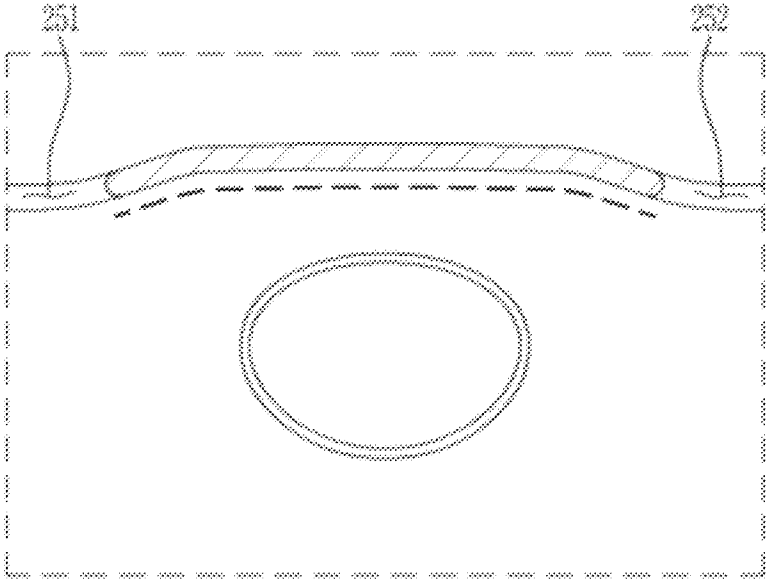

FIG. 5A illustrates a cross-section of the central rib part (155) positioned on the connection support part (150). Besides, FIG. 5B illustrates a cross-section of the second rib part (152) positioned at the connecting support part (150).

With reference to 2(*b*), the connection support part (150) may contain a first curved hole (251) and a second curved hole (252) shaped through the connection support part (150) and laid out side by side in the left and right directions of the connection support part (150). The center rib part 155 positioned between the first curved hole (251) and the second curved hole (252), the first rib part (151) positioned between one side surface of the connection support part (150) and the first curved hole (251) linking the first support part (110) and the second support part (130) and the other side of the connection support part (150). The shapes of the first rib part (151) and the second rib part (152) may be symmetrical.

FIG. 2A is a cross section of the second rib part (152) and the line C-C' for illustrating the position of the line D-D' for the cross section of the central rib portion 155 in FIG. 5A and FIG. 5B.

FIG. 5A illustrates a cross-section of the central rib part (155). With reference to FIG. 5A, in the form of a rear recessed shape between the first curved hole (251) and the second curved hole (252), the depression part may be provided as a curved surface having a very large radius of curvature.

With reference to FIG. 5B, the first rib part (151) and the second rib part (152) may be provided in a corrugated shape in the direction from the second upper support part (112) toward the depression support part (135) to reinforce the rigidity of the connection support part.

The conventional functional sitting chair (1) is provided with angled creases in the area corresponding to the first rib part (151) and the second rib part (152). However, when manufacturing the functional sitting chair (100) by injection molding, a problem arose associated with the stress concentrated on angular wrinkles which could cause more shrinkage than the actual expected size of the product. To complement this, functional sitting chairs (100) described in this disclosure may be provided in the form of wave-shaped wrinkles, not angular wrinkles.

This may be a shape wherein a sinusoidal wave is repeated or a corrugated shape. Any shape will do as long as it is in the form of a smooth curve without sharp bending.

That is, the first rib part (151) may be provided in a wavy shape in a direction from the first curved hole (251) toward the one side face, and at least a part of the second rib part (152) may be provided in a wavy shape in a direction from the second curved hole (252) toward the other side face.

Figure 6B:
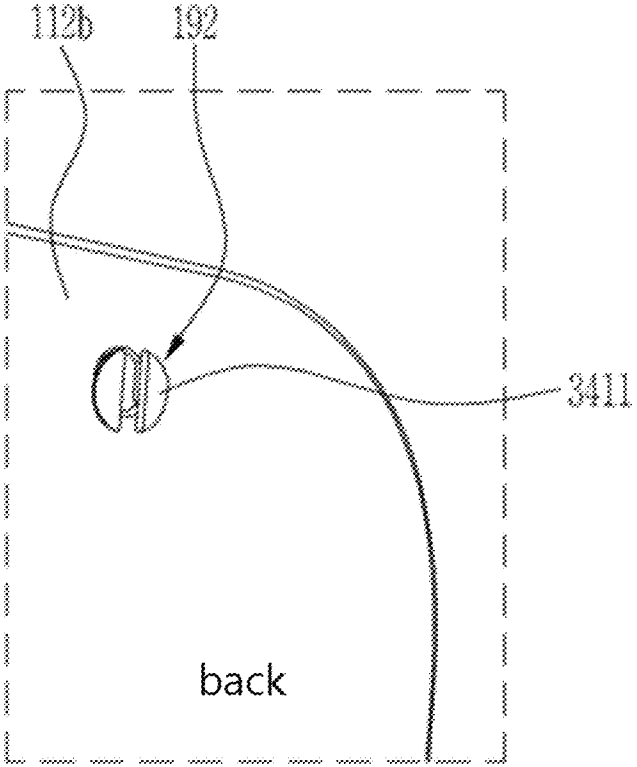
FIGS. 6A and 6B illustrate the hook coupling of the cushion part.
Figure 6A:
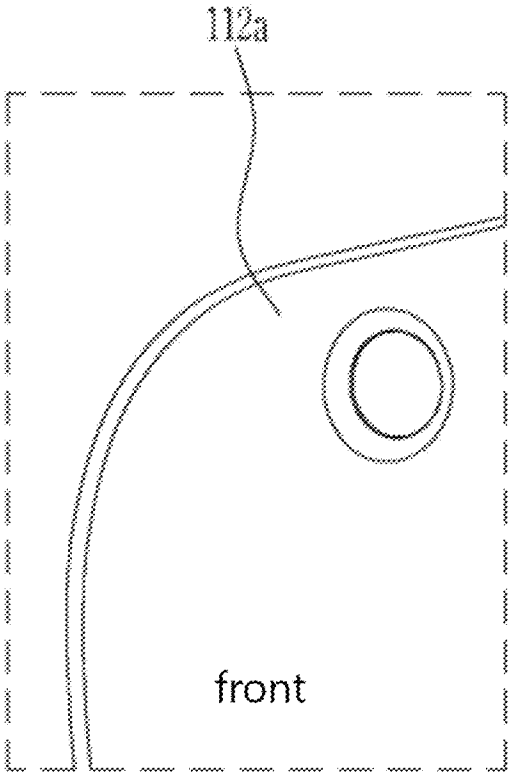

FIG. 6A and FIG. 6B illustrated hook coupling (or snap-fit coupling) that the first through hole (191), the second through hole (192), the third through hole (193), the first coupling hole (195), and the second coupling hole (196). FIG. 6A is a view of the second upper support part rear surface (112*b*) from the rear, and FIG. 6B is a view of the second upper support part front surface (112*b*) from the front side.

The cushion unit (300) may be detachably attached to the functional sitting chair (100). To this end, the cushion part (300), the first support part (110), and the second support part 130 may be coupled to each other utilizing a hook-and-loop fastener (aka Velcro). However, in consideration of the size of the cushion unit (300) and the user's body pressure that can be applied for a long time, it is advantageous to use a snap-fit coupling or a hook coupling.

To this end, the cushion unit (300) is provided at each position with the first through hole (191), the second through hole (192), the third through hole (193), the first coupling hole (195) and it may contain a hook that can be coupled to the second coupling hole (196).

For example, FIG. 6A and FIG. 6B illustrate the upper first hook (3411) inserted into the second through hole (192) of the second upper support part (112).

Figure 7B:
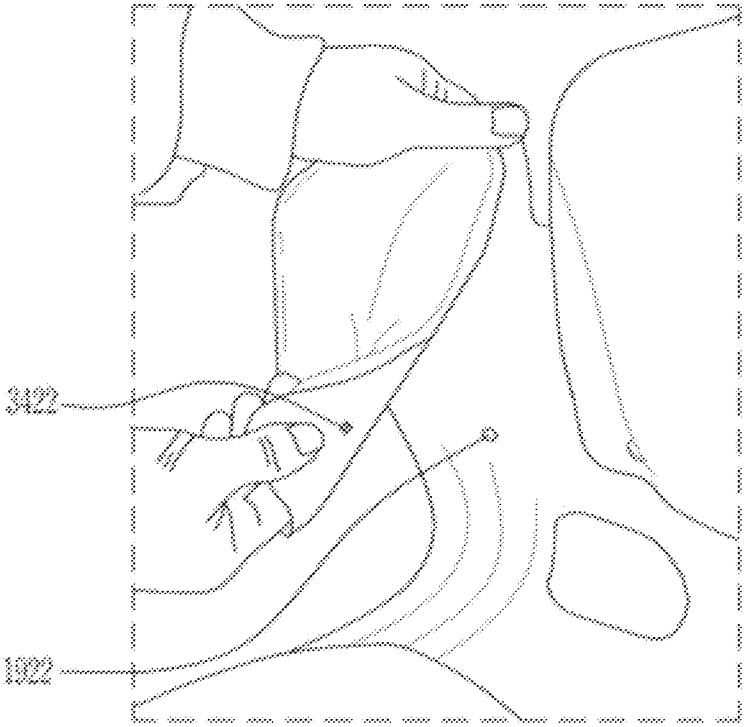
FIGS. 7A and 7B illustrate a method of detaching the cushion part.
Figure 7A:
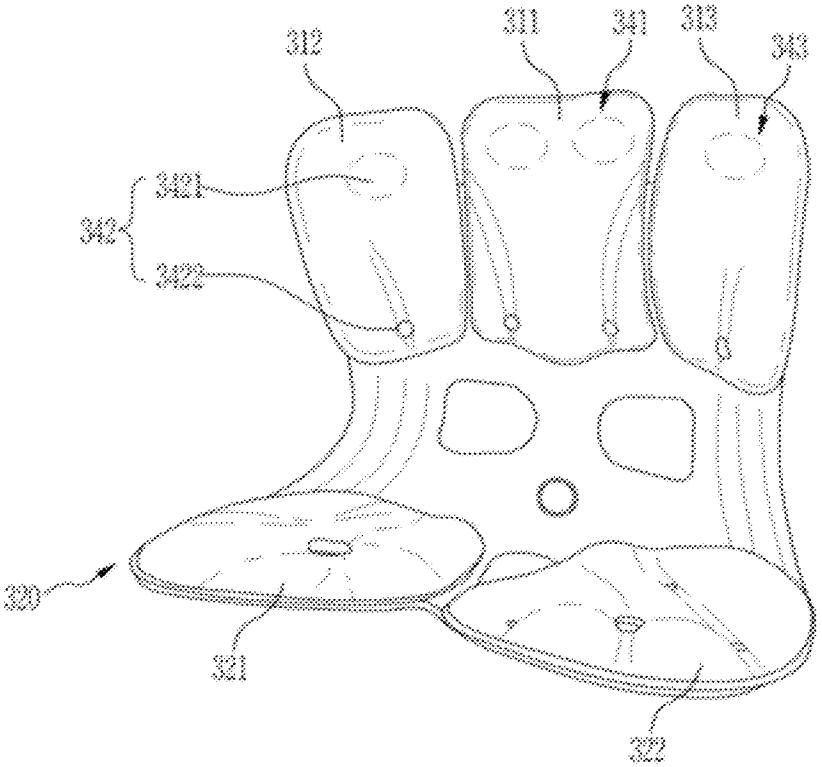

With reference to FIG. 7A, a said cushion unit (300) detachable from the functional legless chair (100) is illustrated. The cushion part (300) may contain an upper cushion part (310) detachable to the first support part (110) and a lower cushion part (320) detachable to the second support part (130).

In other words, the functional legless chair (100) has an upper cushion part (310) detachably coupled to the first support part (110), and a lower cushion part detachably coupled to the second support part 130. (320) may be further contained.

The cushion unit (300) may be provided with elasticity by putting cotton or sponge inside the cushion unit (300) to provide reasonable comfort when the user is seated.

The upper cushion part (310) contains a first cushion (311) that is detachably coupled to the first upper support part (111), and a said second that is detachably coupled to the second upper support part (112). It may contain a cushion (312), and a third cushion (313) detachably coupled to the third upper support part (113).

That is, the upper cushion part (310) may be provided with the same number of the plurality of upper support parts (111, 112, 113). Accordingly, between the first cushion (311) and the second cushion (312) is a place where the first incision (117) is positioned, and between the first cushion (311) and the third cushion (313) is the second incision (119) may be positioned.

The lower cushion part (320) is a first pad (321) detachably coupled to a position contacting any one of the user's buttocks, and the other of the user's buttocks. It may contain a second pad (322) detachably coupled to the position.

That is, the lower cushion part (320) may be provided with the same number of the plurality of lower support parts (131, 132).

Figure 8B:
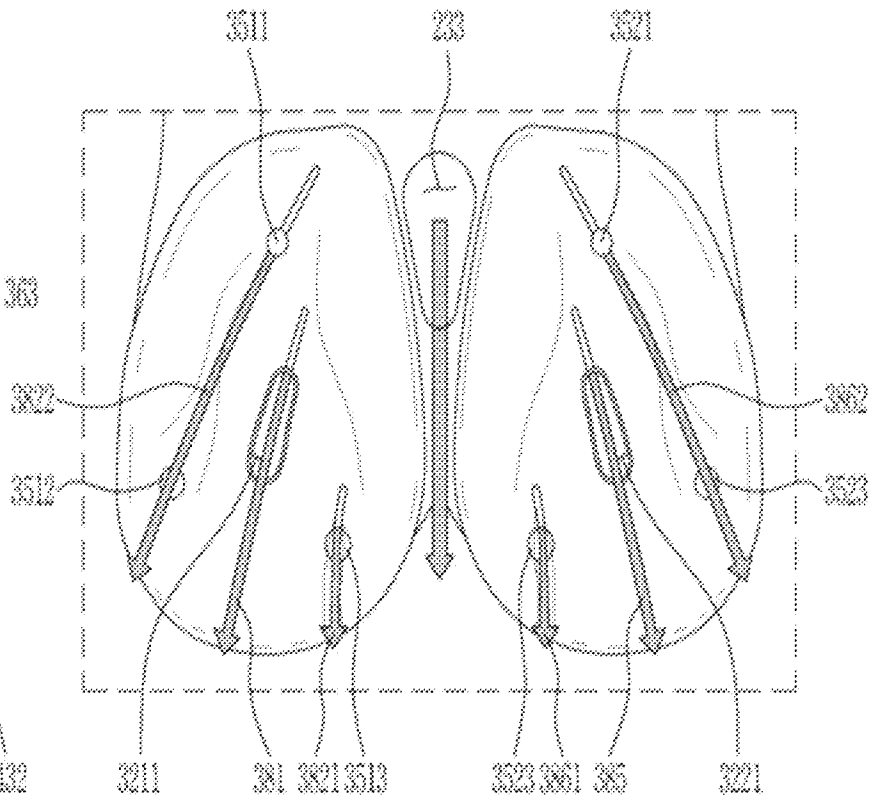

With reference to FIG. 8B, the first pad (321) is provided to face the first hip hole (231), and a said first pad through hole is formed through the first pad (321). (3211), and the second pad (322) is provided to face the second hip hole (232), and contains a second pad through hole (3221) shaped through the first pad (321).

Therefore, the first hip hole (231) and the first pad through hole (3211) may communicate to provide a passage through which air moves. Likewise, the first hip hole (231) and the second pad through hole (3221) may also communicate to provide a passage for air movement.

The first pad (321) and the second pad (322) may have a round shape along the shape of the second support part.

With reference to FIG. 7A, the first cushion (311) may contain a first cushion hook (341) provided at a position facing the first through-hole (191). The second cushion (312) may contain a second cushion hook (342) provided at a position facing the second through hole (192). Besides, the third cushion (313) may contain a third cushion hook (343) provided at a position facing the third through hole (193).

The first cushion hook (341), the second cushion hook (342), and the third cushion hook (343) may be positioned inside of the first cushion (311), the inside of the second cushion (312), and inside the third cushion respectively (313).

In contrast, the first cushion hook (341) has the first cushion hook (341) on the surface contacting the user, the head of the first cushion hook (341) is exposed, the first cushion hook (341) may be provided in the form of penetrating the first cushion (311) so that the hook portion faces the first through hole (191). Besides, a hook portion of the first cushion hook (341) will be coupled to the first through hole (191).

This is to form a depression on the surface of the first cushion (311) contacting the user to form a part of the passage for circulating air, or to prevent the sponge or cotton that may be positioned inside the first cushion from moving unintentionally to one side.

The second cushion hook (342) and the third cushion hook (343) are also in the same form as the first cushion hook (341) for the second cushion (312) and the third cushion (313), respectively. and will be coupled to the second through-hole (192) and the third through-hole (193), respectively.

For instance, with reference to 7(*a*), the first cushion hook (341) illustrates a state of provision on the upper and lower parts of the first cushion (311), respectively. The hook positioned at the upper part of the first cushion (311) will not be exposed when viewed from the front because the head of the hook is positioned inside the first cushion. Such being the case, only the location is outlined roughly with a dotted line. On the flip side, the hook positioned under the first cushion (311), the head of the hook may be exposed to the outside.

The position of the hooks, the size of the hooks, and the number of hooks being examples, the position, size, and number of hooks may vary markedly.

Besides, FIG. 7A illustrates an example wherein the second cushion (312) contains one each of the second cushion hooks (3421 and 3422) in the upper and lower parts. The same applies to the said third cushion (313).

That is, the said first cushion hook (341), the said second cushion hook (342), and the said third cushion hook (343) are the said first through hole (191) and the said second through hole (192), respectively and is inserted into the third through hole (193) to be hook-coupled.

FIG. 7B illustrates an example of separating the said lower second hook (3422) into which the lower second through-hole (1922) was inserted. By simple separation of the hook provided on each cushion, the user can separate the upper cushion part (310) and then combine it again to use it. Thus, for example, an old cushion can be replaced with a new cushion.

Even at the time of coupling, by inserting the hooks provided in each cushion into the through-holes facing each hook, it will be possible to be re-engaged.

And, so is the lower cushion (320). With reference to FIG. 8B, the first pad (321) contains the said first pad hook (351) provided at a position facing the first coupling hole (195), and the second pad (322) may contain a second pad hook (352) provided at a position facing the second coupling hole (196).

In other words, the first pad hook (351) and the second pad hook (352) may be hook-coupled by being inserted into the first coupling hole (195) and the second coupling hole (196), respectively.

FIG. 8B illustrates that the first pad hook (351) is provided with three hooks (1951, 1952, and 1953), and the second pad hook (352) also has three hooks (1961, 1962, 1963) illustrating an example.

On the other hand, if a separate hook is used or hooks installed on the cushion part are used, other objects may be installed in the through holes (191, 192, 193) and the coupling holes (195 and 196).

FIG. 8A and FIG. 8B illustrate a ventilation unit that may be shaped in the functional legless chair (100) in an effort to maintain comfort even when the user sits for a long time.

When the user is seated, air may be introduced and flows out through the air hole (200), but the cushion unit (300) may have a pattern for forming a kind of air passage on the surface contacting the user.

The upper cushion part (310) is the upper cushion part (310) containing an upper cushion ventilation part (360), and the lower cushion part (320) is the lower cushion ventilation part (380) wherein contains a part of the surface contacting the user's buttocks recessed in a groove shape to form a path for air movement.

That is, the upper cushion ventilation part (360) and the lower cushion ventilation part (380) may be provided in the shape of a channel extending lengthwise and opened.

With reference to FIG. 8A, the first cushion (311), the second cushion (312), and the third cushion (313) each have a part of a surface contacting the user's waist region is a groove. It may contain a first upper channel (3611 and 3612), a second upper channel (362), and a third upper channel (363) which are recessed in a groove shape to form a path through which air circulates upward.

Besides, the air flowing between the first cushion (311) and the second cushion (312) can quickly escape to the outside through the first incision (117). Also, between the first cushion (311) and the third cushion (313), air may quickly escape to the outside through the second incision (119).

The first upper channel (3611 and 3612) has a plurality of curved lines toward both sides of the first cushion so that air can flow toward the first incision (117) and the second incision (119), respectively. It may be provided with four channels.

The length, position and number of channels may vary as long as the air can flow quickly.

With reference to FIG. 8B, the first pad (321) communicates with the first pad through hole (3211) and the first hip hole (231) and is contacting any one of the buttocks. A portion of the groove may contain a first communication channel (381) to form a path through which air is circulated toward the front. The second pad (322) communicates with the second pad through hole (3221) and the second hip hole (232), and a part of a surface contacting the other buttocks is recessed in a groove shape to form a front. It may contain a second communication channel (385) that forms a path through which air is circulated toward.

Besides, the first pad (321) contains at least one first front channel that is spaced apart from both sides of the first communication channel (381) and is recessed into a groove shape. And, the second pad (322) may contain at least one second front channel which is positioned to be spaced apart from one side of both sides of the second communication channel (385) and is recessed into a groove shape.

FIG. 8B illustrates an example wherein each pad has one communication channel and two front channels. That is, the first pad (321) may contain two first front channels (3821 and 3822) provided to be spaced apart from both sides of the first communication channel (381). Besides, the second pad (322) may contain two second front channels (3861 and 3862) provided to be spaced apart from both sides of the second communication channel (382). The first front channels (3211 and 3212) and the second front channels (3861 and 3862) may have a curved shape.

In the meantime, the first pad (321) and the second pad (322) may be positioned to prevent overlapping with the hip center hole (233) when attached to the second support unit (130). Such being the case, a portion of the air introduced through the hip center hole (233) may flow toward the front incision (137) through between the first pad (321) and the second pad (322).

Since the space between the first pad (321) and the second pad (322) is empty even when the user is seated, a passage for air can be formed.

Figure 9B:
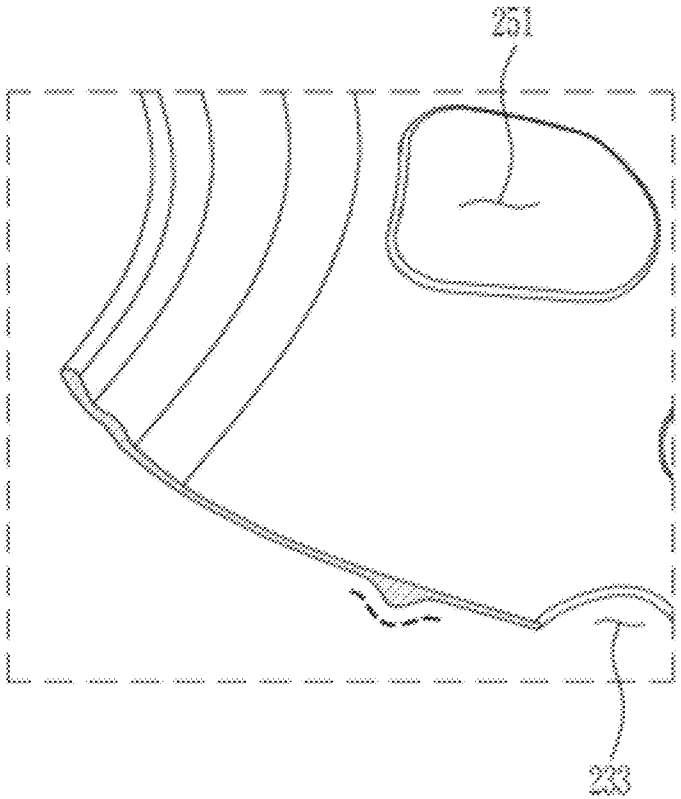
FIGS. 9A and 9B illustrate the protrusion formed on the bottom surface of the functional legless chair.
Figure 9A:
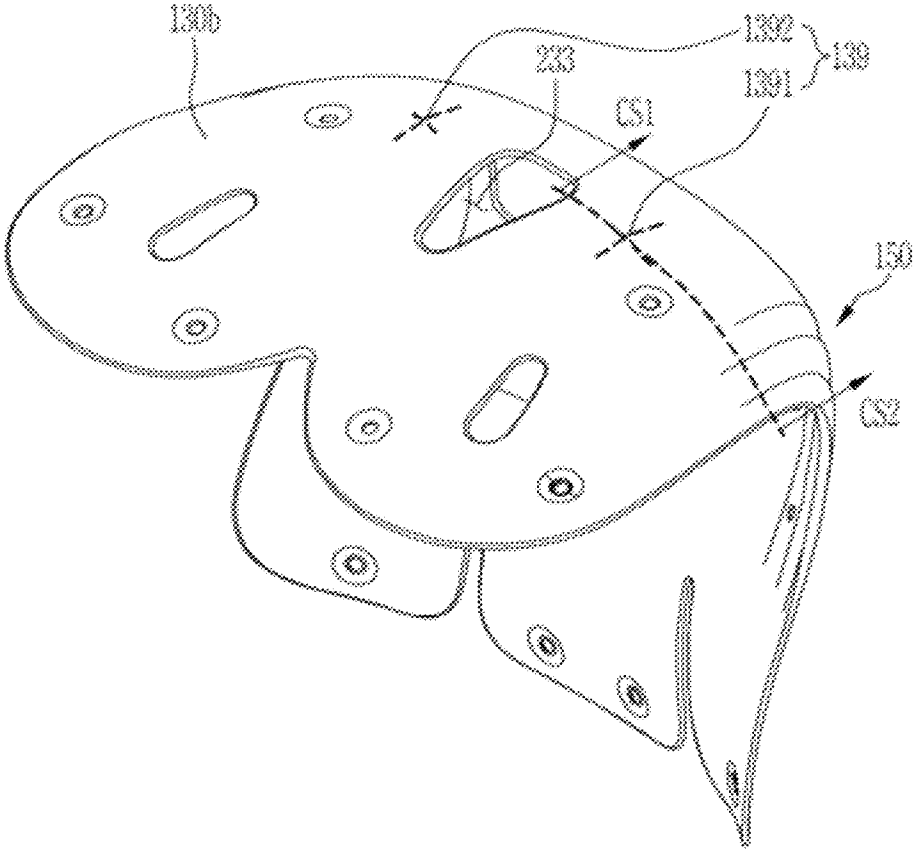

With reference to FIG. 9A, the functional legless chair (100) has a first protrusion (1391) formed to protrude from the rear surface of the second support (130) to support the second support (130) and a second protrusion (1392).

The functional legless chair (100) can be shaken left and right when the user is seated by the recessed support part (135) shaped in a curved surface. When the functional legless chair (100) is used on a soft floor surface such as a sofa or cushion chair, the floor surface may be deformed depending on the shape of the functional legless chair (100). Such being the case, left and right shaking of the functional legless chair (100) can be minimized.

However, when the functional legless chair (100) is used on a hard floor, the shaking of the functional legless chair (100) may be strongly felt depending on the user.

The first protrusion (1391) and the second protrusion (1392) are for reducing the shaking of the functional sitting chair (100).

That is, the first protrusion (1391) and the second protrusion (1392) may be shaped to be spaced apart from each other by a predetermined distance in the left and right direction from the hip center hole (233). In other words, the first protrusion (1391) and the second protrusion (1392) may be provided on the left and right sides of the second support (130), respectively. If the second support part (130) is about to rotate by receiving a force in the right direction, since the second protrusion (1392) is contacting the floor surface, it is possible to prevent the rotation of the functional legless chair (100), and on the contrary, if the support unit (130) is to rotate by receiving a force in the left direction, since the first protrusion (1391) is contacting the floor surface, the rotation of the functional legless chair (100) could be prevented.

That is, the first protrusion (1391) and the second protrusion (1392) will play a role as a support for fixing the curved depression support part (135) from the bottom surface.

FIG. 9B illustrates a state wherein the first protrusion (1391) is cut along the line marked CS1-CS2. The first protrusion (1391) may have a shape protruding from the rear surface (130*b*) of the second support part.

FIG. 9A and FIG. 9B illustrate an example of a functional legless chair (100) containing protrusions (1391 and 1392) protruding to prevent left and right shaking, and a kind of leg. The first protrusion (1391) and the second protrusion (1392) protrude from the second support part (130) and are fixed to the second support part (130).

However, the shaking of the functional legless chair (100) in the left and right direction when the user is seated may be necessary depending on the user's environment.

For example, shaking in the left and right direction of the functional sitting chair (100) may be effective for core muscle training of the user. Core muscles denote the skeletal and muscles associated with the vertical axis of the spine and the horizontal axis of the abdomen, lower back, pelvis, and diaphragm. Strengthening these core muscles can help maintain the body's balance and correct posture.

On the contrary, depending on the user's environment, the user may have preference for preventing the shaking of the functional legless chair (100) in the left and right direction. Such being the case, it would be desirable to allow the user to select the shaking in the left and right direction of the functional legless chair (100) in accordance with the user's use environment.

To this end, FIG. 10A to FIG. 10D illustrates an example of the user can attach and detach the leg, the projecting detachable portion (138). That is, FIG. 9A and FIG. 9B illustrate an example wherein the protrusions (1391) and (1392) serving as legs are integrally shaped with the second support 130 and fixed. On the contrary, FIG. 10A to FIG. 10D illustrate an example wherein the protruding detachable part (138) playing the role as a leg is detachable from the second support part (130) by the user's selection.

Figure 10B:
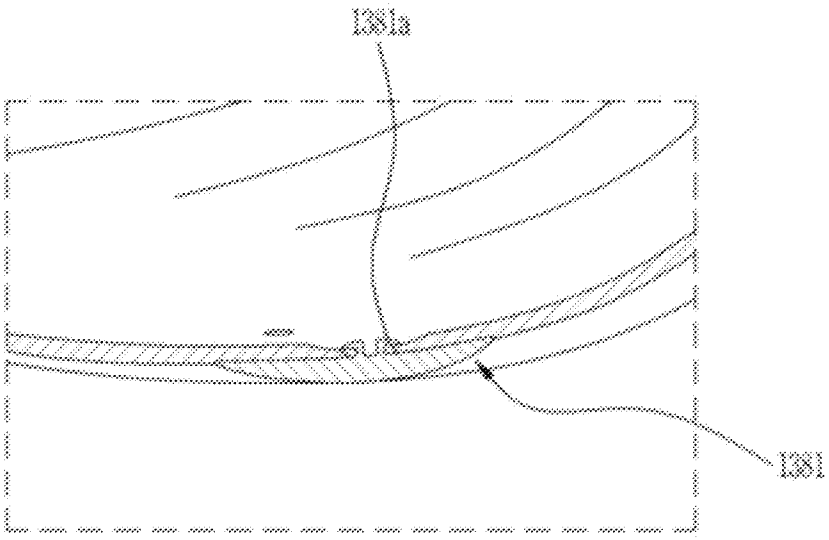
FIGS. 10A-10D illustrate a protruding detachable part detachably provided on the bottom surface of the functional chair.
Figure 10A:
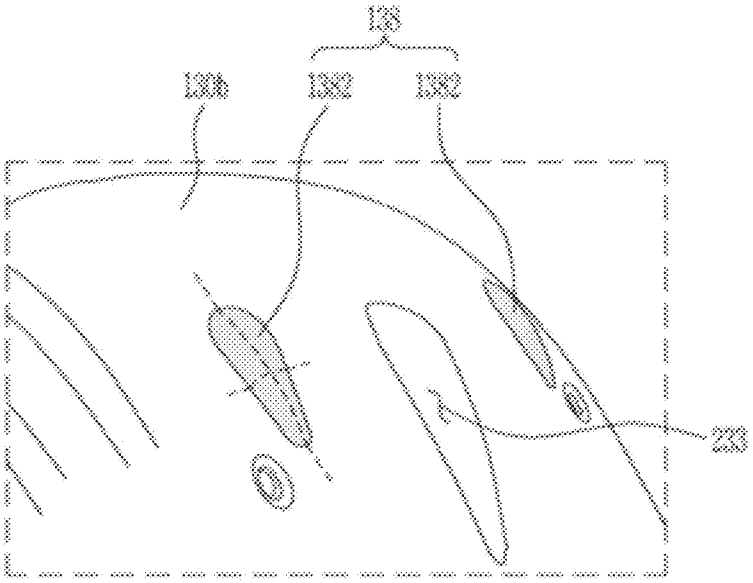
Figure 10D:
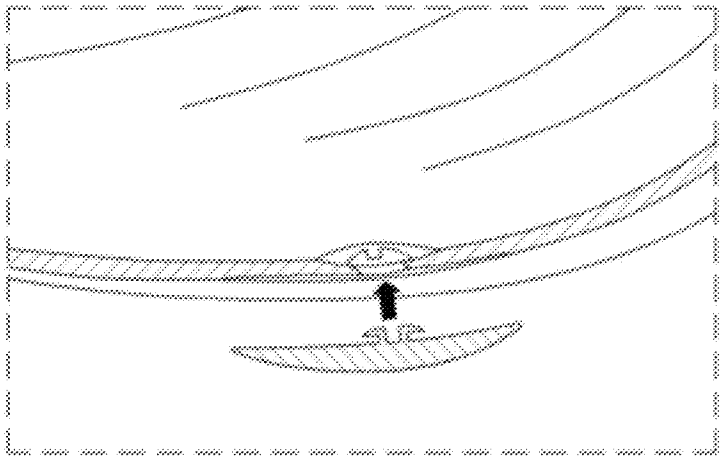
Figure 10C:
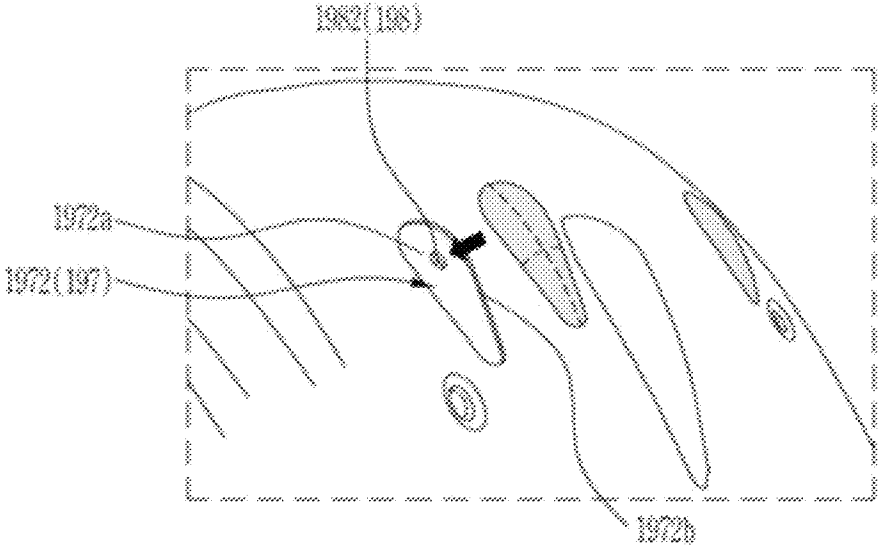

With reference to FIG. 10A and FIG. 10C, the second support part (130) contains a fastening hole (198) shaped through the depression support part (135) and the fastening hole (198). It further contains a protruding detachable part (138) detachably coupled to the protruding detachable portion (138) may protrude more than the rear surface of the second support part (130) when coupled to the fastening hole (198).

Such being the case, when the protruding detachable part (138) is coupled to the fastening hole (198), in such a way the above-described protruding parts (1391) and 1392, the functional legless chair (100) can be prevented from shaking in the left and right directions.

The fastening hole portion (198) can be shaped through the second support portion (130), specifically, the depression support part (135) for coupling of the protruding and detachable portion (138).

The protruding detachable part (138) and the fastening hole portion (198) can be coupled by hook coupling. However, this is only an isolated example, and may be detachably coupled by other coupling methods.

Specifically, the first protruding leg (1381) and the second protruding leg (1382) may be hook-coupled to the first fastening hole (1981) and the second fastening hole (1982), respectively.

And, the fastening hole part (198) may contain a first positioned between one side of the second support part (130) at the center of the second support part (130) along the width direction of the second support part (130). A second fastening hole (1982) positioned between the fastening hole (1981) and the other side of the second supporting part (130) at the heart of the second supporting part (130) along the width direction of the second supporting part (130).

The second support part (130) may contain a first fastening hole (1981) and a second fastening hole (1982) that are spaced apart from each other by a preset distance in the left and right directions from the hip center hole (233).

Besides, the protruding detachable portion (138) is detachably coupled to the first protruding leg (1381) detachably coupled to the first fastening hole (1981), and the second fastening hole (1982). A second protrusion leg (1381) may be contained. Besides, the first protruding leg (1381) and the second protruding leg (1382) may protrude further beyond the rear surface of the second support part (130) when coupled to the first fastening hole (1981) and the second fastening hole (1982), respectively.

On the contrary, when the first protruding leg (1381) and the second protruding leg (1382) are combined with the first fastening hole (1981) and the second fastening hole (1982), respectively, the first protruding leg (1381) and the second protruding hole (1382) rotate the first fastening hole (1981) and the second fastening hole (1982), respectively.

In order to prevent this and guide the coupling of the protruding and detachable part (138) to the fastening hole part (198) in a certain shape, the second support part (130) is fastened in the depression support part (135). A predetermined region including the hole part (198) may contain a leg attachment/detachable part (197) having a recessed shape in accordance with the size of the surface to which the protruding/detachable part (138) is coupled.

FIG. 10C illustrates a second detachable part (1972) wherein the depression support part (135) is recessed to correspond to the size of the surface of the second protruding leg (1382) facing the second fastening hole (1982) is shown. The second detachable part (1972) is recessed to form a second recessed surface (1972*a*) forming a surface to which the second protruding leg is coupled, and side surfaces of the second recessed surface (1972*a*), and the second recessed surface (1972*a*) and a second recessed side surface (1972*b*) linking the rear surface (130*b*) of the second support part, and the second fastening hole (1982) may be positioned on the second recessed surface (1972*a*).

The second detachable part (1972) of the recessed shape does not protrude convexly corresponding to the recessed shape of the front surface of the second support part, that is, the side on which the user is seated, but rather of the second support part. A portion of the rear surface (130*b*) may be formed by cutting in the thickness direction.

When the second protruding leg (1382) is hooked into the second fastening hole (1982) positioned on the second hollowed surface (1972*a*), it is possible to prevent the rotation of second protruding leg (1382) by the second depression side surface (1972*b*).

Besides, when the user couples the second protruding leg (1382) to the second fastening hole (1982), the second protruding leg (1382) can be more easily coupled to the second fastening hole (1982) by guiding the coupling by the second hollowed side (1972*b*).

Besides, the shape of the second protruding leg (1382) and the second detachable part (1972) may be provided in an asymmetrical shape rather than a symmetrical shape such as a spherical shape when viewed from above.

For instance, the first protruding leg (1381) and the second protruding leg (1382) may have a front and rear length longer than a left and right length, respectively.

Consequently, the second protruding leg (1382) is prevented from being rotated in its place, and the user will always be able to couple the second protruding leg (1382) in a certain direction.

Although not shown in the drawing, the first detachable part (1971) performing the same function as the second detachable part (1972) is also a first hollowed surface that fulfills the same function as the second detachable part (1972) and a first hollowed side surface, in which the first fastening hole 1981 will be positioned on the first hollowed side.

Consequently, the first protruding leg (1381) may also be coupled with the first detachment (not illustrated) wherein the depression support part (135) is recessed to correspond to the size of the surface facing the first fastening hole.

FIG. 10B illustrates a state wherein the first protruding leg (1381) is hook-coupled to the first fastening hole (1981). The first protruding leg (1381) has a protruding hook (1381*a*) on a surface facing the first fastening hole (1981), and the first protruding leg (1381) is linked to the first through the protruding hook (1381*a*). It can be coupled to the rear surface (130*b*) of the support.

Although not shown in the drawings, the second protruding leg (1382) also has a protruding hook, similar to the first protruding leg (1381), to be coupled to the rear surface (130*b*) of the second support part.

FIG. 10D illustrates a state before coupling the first protruding leg (1381) to the second support part (130) through the first fastening hole (1981). This is also the case for the second protruding leg (1382).

On the contrary, the user applies force to the protruding hooks provided on each protruding leg while in a state wherein the first protruding leg (1381) and the second protruding leg (1382) are coupled to the second supporting part (130), pulling each of the protruding hooks through the first protruding leg (1981) and second protruding leg (1381)

Figure 11B:
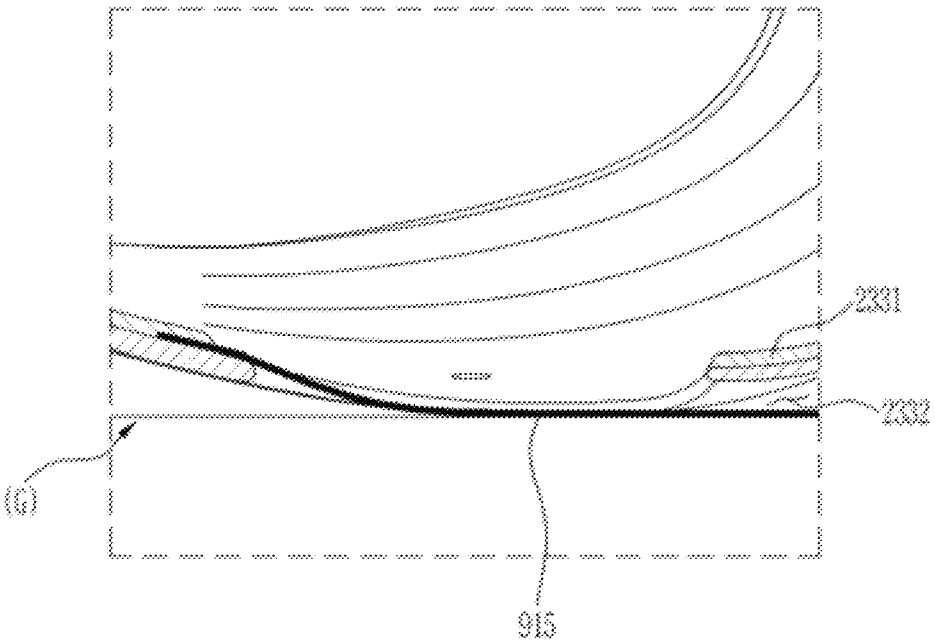
FIGS. 11A and 11B illustrate a separation space formed between the bottom surface and the second support part for the protection of the cable passing under the second support part.
Figure 11A:
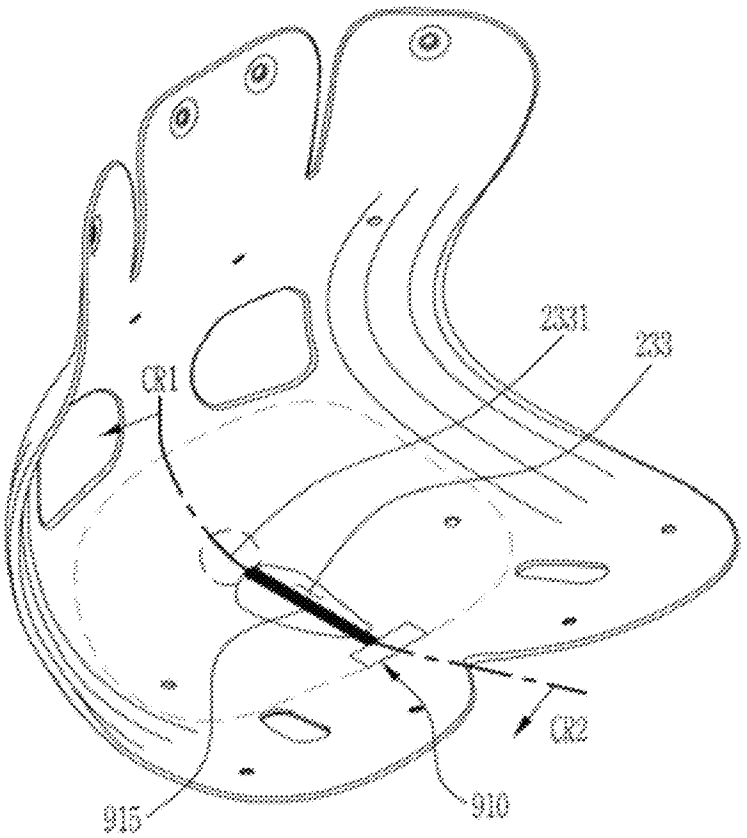

FIG. 11A illustrates a heating unit (910) for heating the functional legless chair (100). Depending on the environment wherein the functional chair (100) is used, a heating function capable of warming the buttocks of the user may be required when the user is seated. To this end, the functional legless chair (100) may contain a heating unit (910) for heating at least a portion of the second support unit 130.

The heating part (910) may be provided to heat not only the second support part (130) but also the first support part (110).

Besides, the heating unit (910) may use a heating wire. However, considering that the functional sitting chair is integrally formed in the shape of a thin curved sheet, preferably, the heating unit (910) may be a film heater provided in the form of a film. Since the film heater is flexibly deformable, it can be deformed according to shape of the second support and attached to the upper the surface of the second support.

In FIG. 11A, the position of the film heater is schematically indicated by a dotted line. In order to use the film heater, it is absolutely essential to supply electricity from the outside. A battery may be used, but considering the usage time of the heating unit (910), this is because there is insufficient free space for installing the battery in the functional sitting chair (100).

To this end, the functional legless chair (100) may further contain a cable (915) for supplying power to the heating unit (910). Besides, the cable (915) may be inserted from the rear surface of the second support part (130) to the front surface of the second support part (130) through the hip center hole (233) to be electrically connected to the heating part 910.

However, even if the cable (915) passes through the hip center hole (233), there is a risk that the cable (915) may be opened by the second support part. To prevent this, a space wherein the cable (915) can safely pass from the rear of the functional legless chair (100) to the hip center hole (233) is required.

To this end, a region positioned at the rear of the hip center hole in the depression support part may contain a protruding depression (2331) shaped by raising upward from the hip center hole toward the connection support, and the cable (915) may be inserted into the hip center hole (233) through a separation space formed at the lower part of the protruding depression to be electrically connected to the heating unit (910).

In FIG. 11B, a part cut by CR1-CR2 is illustrated in an enlarged manner. The cable (915) may be positioned in a region positioned between the hip center hole (233) and the connection support part (150) at a lower portion of the region positioned at the rear of the hip center hole. At this time, when the cable (915) is repeatedly pressed by the depression support part (135), the cable (915) may be disconnected.

Thus, in the depression support part (135), a portion of the region positioned between the hip center hole (233) and the connection support part (150) among the depression support parts (135) is the hip center hole (233) and it further contains a protruding depression (2331) shaped by protruding upward in the direction toward the connection support (150), and the cable (915) is a spaced area (2332) formed in the lower portion of the protruding depression (2331) which may be inserted through and electrically connected to the heating unit (910).

FIG. 11B is an example illustrating that the cable (915) passes through the separation space (2332) formed under the depression support part (135) by the protruding depression (2331). Even if the depression support part (135) receives a user's load, the separation space (2332) is secured and thereby the risk of a short circuit of the cable (915) can be minimized.

Figure 12B:
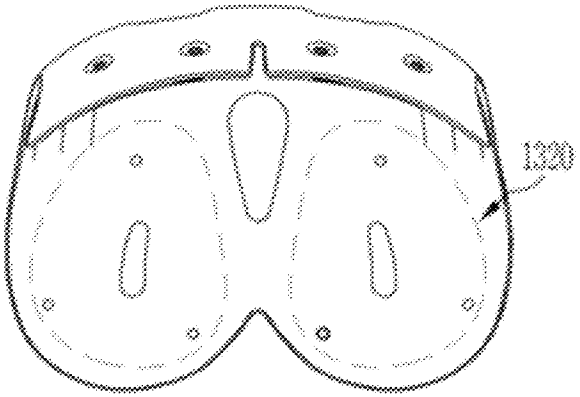
FIGS. 12A-12C illustrate another embodiment of the functional legless chair described in the present disclosure.
Figure 12C:
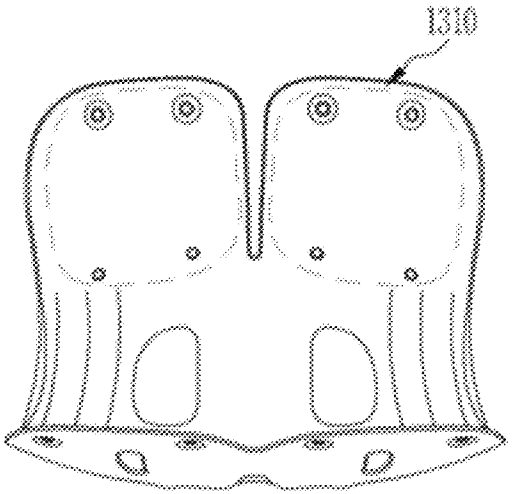
Figure 12A:
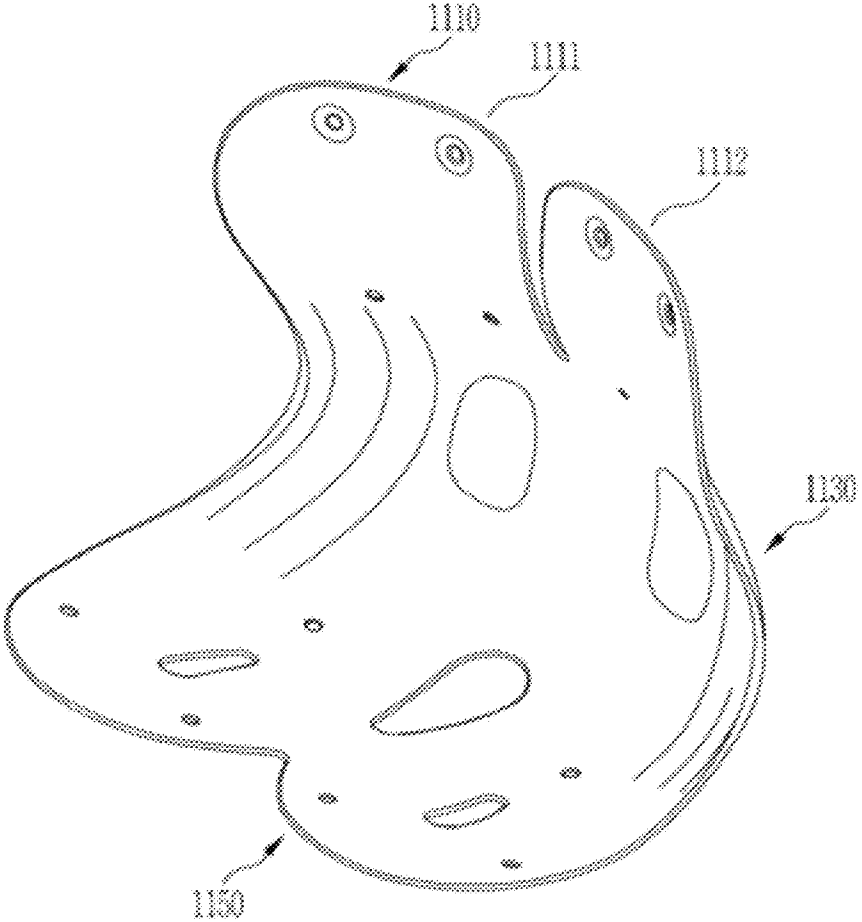

FIG. 12A to FIG. 12C illustrate another embodiment of the functional legless chair (1000). A plurality of upper support parts (1110) may be provided to distribute the user's body pressure. With reference to FIG. 12A, the upper support parts (1110) are separated from each other by a first upper support part (1111) and a second upper support part (1110). Another embodiment is illustrated wherein two upper support parts (1112) are contained and only one incision is contained between the first upper support part (1111) and the second upper support part (1112).

On the contrary, as described above, the lower support part (1150) may be separated into two because it should support both buttocks and both thighs, respectively.

Such being the case, with reference to FIG. 12B and FIG. 12C, the upper cushion part (1310) will also be able to detach and attach the two cushions to the first support part (1111) and the second support part (1112), respectively.

The first upper support part (1111) may contain at least one through hole (not illustrated) for attaching and detaching a cushion to the first upper support part (1111). Similarly, the second upper support part (1112) may contain at least one through hole (not illustrated) for attaching and detaching a cushion to the second upper support part (1112).

The present disclosure may be modified and embodied in various forms, but the scope of rights is not confined to the above-described embodiment. Therefore, if the modified embodiment contains the elements of the claims of the present disclosure, it should be regarded as belonging to the scope of the present disclosure.

What is claimed is:

1. A functional legless chair comprising:

a first support part for supporting at least a part of a waist of a user when the user is seated;

a second support part positioned below a lower part of the first support part for supporting at least a part of buttocks and both thighs of the user when the user is seated; and a connection support part connecting the first support part and the second support part, wherein the first support part comprising:

a support coupling part adapted to surround the waist of the user, the support coupling part connected to the connection support part; and a plurality of upper support parts extending upward from the support coupling part, wherein the second support part comprising:

a depression support part having a recess configured to receive the buttocks of the user; and a plurality of lower support parts extending from the depression support part, wherein the second support part further comprises:

a fastening hole formed through the depression support part; and a protruding detachable part detachably coupled to the fastening hole, wherein the protruding detachable part protrudes from a rear surface of the second support part when coupled to the fastening hole.

2. The functional legless chair according to claim 1, wherein the first support part rises upward from the support coupling part, it is inclined toward the front;

the second support part inclines upward toward the front from the depression support part;

the connection support part is linked to a curved surface protruding rearward to the first support part and the second support part, when a user is seated, the first support part and the second support part rotate in the same direction.

3. The functional legless chair according to claim 2, wherein the plurality of upper support parts comprises:

a first upper support part extending upward from the support coupling part to support a spine of the user; and a second upper support part and a third upper support part extending upward from the support coupling part and positioned on both sides of the first upper support part, respectively, wherein the first support part further comprises:

a said first incision positioned between the first upper support part and the second upper support part to separate the first upper support part and the second upper support part; and a second incision part positioned between the first upper support part and the third upper support part to separate the first upper support part and the third upper support part.

4. The functional legless chair according to claim 2, wherein the plurality of lower support parts comprises a first lower support part and second lower support part extending forward from the depression support part, wherein the second support part further comprises a front incision positioned between the first lower support part and the second lower support part to separate the first lower support part and the second lower support part.

5. The functional legless chair according to claim 4, wherein the functional legless chair further comprises:

an upper cushion part detachably coupled to the first support part; and a lower cushion part detachably coupled to the second support part.

6. The functional legless chair according to claim 5, wherein the plurality of upper support parts comprises:

a first upper support part extending upward from the support coupling part to support a lumbar spine of the user; and a second upper support part and a third upper support part extending upward from the support coupling part and positioned on both sides of the first upper support part, respectively, wherein the upper cushion part comprises:

a first cushion detachably coupled to the first upper support part;

a second cushion detachably coupled to the second upper support part; and a third cushion detachably coupled to the third upper support part, wherein the lower cushion part comprises:

a first pad detachably coupled to a position configured for contacting any one of the buttocks of the user; and a second pad detachably coupled to a position configured for contacting the other of the buttocks of the user.

7. The functional legless chair according to claim 6, wherein the first upper support part has a first through-hole, the second upper support part has a second through-hole, and the third upper support part has a third through-hole:

the second support part comprises a first coupling hole shaped through the second support, and a second coupling hole;

the first cushion comprises a first cushion hook provided at a position facing the first through hole;

the second cushion comprises a second cushion hook provided at a position facing the second through hole;

the third cushion comprises a third cushion hook provided at a position facing the third through hole;

the first pad comprises a first pad hook provided at a position facing the first coupling hole;

the second pad comprises a second pad hook provided at a position facing the second coupling hole; and each of the first cushion hook, the second cushion hook, the third cushion hook, the first pad hook and the second pad hook are respectively inserted into the first through hole, the second through hole, the third through hole, the first coupling hole and the second coupling hole to be hook-coupled.

8. The functional legless chair according to claim 5, wherein the upper cushion part comprises an upper cushion ventilation part that forms a path for air movement, the upper cushion ventilation part is recessed in a groove shape, and wherein the lower cushion part comprises a lower cushion ventilation part that forms a path for the air movement, and the lower cushion ventilation part is recessed into a groove shape.

9. The functional legless chair according to claim 6, wherein first cushion has a first upper channel, the second cushion has a second upper channel, and the third cushion has a third upper channel, the first upper channel, the second upper channel, and the third upper channel that are recessed in a groove shape to form a path for air circulation.

10. The functional legless chair according to claim 6, wherein the second support part comprises:

a first hip hole in which one side of both sides of the second support part is positioned closer than the other side and is formed through the second support part; and a second hip hole in which the other side of both sides of the second support part is positioned closer than one side and is formed through the second support part, wherein the first pad comprises a first pad through hole provided to face the first hip hole and formed through the first pad;

the second pad comprises a second pad through hole provided to face the second hip hole and formed through the first pad;

the first pad comprises a first communication channel that communicates with the first pad through hole and the first hip hole and forms a path through which air is circulated in a forward direction by recessing a part of a surface contacting the one of the buttocks into a groove shape; and the second pad comprises a second communication channel that communicates with the second pad through hole and the second hip hole and forms a path through which air is circulated in the forward direction by recessing a part of a surface contacting the other buttocks in a groove shape.

11. The functional legless chair according to claim 10, wherein the first pad comprises a first front channel spaced apart from at least one of both sides of the first communication channel and recessed into a groove shape; and the second pad comprises a second front channel spaced apart from at least one of both sides of the second communication channel and recessed into a groove shape.

12. The functional legless chair according to claim 11, wherein each of the first front channel and the second front channel is formed in a curved shape.

13. The functional legless chair according to claim 6, wherein the functional legless chair further comprises a hip center hole shaped through the depression support part.

14. The functional legless chair according to claim 1, wherein the fastening hole comprises:

a first fastening hole positioned between one side of the second support part at a center of the second support part along a width direction of the second support part; and a second fastening hole positioned between the other side surface of the second support part at the center of the second support part along the width direction of the second support part, wherein the protruding detachable part further comprises:

a first protrusion leg detachably coupled to the first fastening hole; and a second protruding leg detachably coupled to the second fastening hole, wherein the each of the first protruding leg and the second protruding leg protrudes from the rear surface of the second support part.

15. The functional legless chair according to claim 1, wherein the connection support part comprises a first curved hole and a second curved hole shaped through the connection support part and arranged side by side in the left and right directions of the connection support part, the second support comprises:

a hip center hole shaped through the depression support part;

a first hip hole in which one side of both sides of the second support part is positioned closer than the other side before the hip center hole and is shaped through the second support part; and a second hip hole, in which the other side of both sides of the second support part is positioned closer than one side in front of the hip center hole and is shaped through the second support part.

16. The functional legless chair according to claim 1, wherein the first support part, the second support part, and the connection support part are provided with an elastic material; and the functional legless chair is integrally injection-molded.

17. A functional legless chair comprising:

a first support part for supporting at least a part of a waist of a user when the user is seated;

a second support part positioned below a lower part of the first support part for supporting at least a part of buttocks and both thighs of the user when the user is seated; and a connection support part connecting the first support part and the second support part, wherein the first support part comprising:

a support coupling part adapted to surround the waist of the user, the support coupling part connected to the connection support part; and a plurality of upper support parts extending upward from the support coupling part, wherein the second support part comprising:

a depression support part having a recess configured to receive the buttocks of the user; and a plurality of lower support parts extending from the depression support part, wherein the functional legless chair further comprises:

a hip center hole formed through the depression support part;

a heating unit for heating at least a part of the second support part; and a cable for supplying power to the heating unit, wherein the cable is to inserted into a front surface of the second support part from a rear surface of the second support part through the hip center hole to be electrically connected to the heating unit.

18. The functional legless chair according to claim 17, wherein the depression support part comprises:

a protruding depression part formed by protruding upward in a direction from the hip center hole toward the connection support part, wherein a portion of an area positioned between the hip center hole and the connection support part contains the protruding depression part, wherein the cable is electrically linked to the heating unit by being inserted into a separation space formed under the protruding depression part.

19. A functional legless chair comprising:

a first support part for supporting at least a part of a waist of a user when the user is seated;

a second support part positioned below a lower part of the first support part for supporting at least a part of buttocks and both thighs of the user when the user is seated; and a connection support part connecting the first support part and the second support part, wherein the first support part comprising:

a support coupling part adapted to surround the waist of the user, the support coupling part connected to the connection support part; and a plurality of upper support parts extending upward from the support coupling part, wherein the second support part comprising:

a depression support part having a recess configured to receive the buttocks of the user; and a plurality of lower support parts extending from the depression support part, wherein the connection support part comprises:

a first curved hole and a second curved hole formed through the connection support part and disposed in parallel in the left and right directions of the connection support part;

a central rib positioned between the first curved hole and the second curved hole;

a first rib part positioned between one of outer surfaces of the connection support part and the first curved hole to link the first support part and the second support part; and a second rib part positioned between the other side of the outer surface of the connection support part and the second curved hole and linking the first support part and the second support part, wherein at least a portion of the first rib part is provided in a wavy shape in a direction from the first curved hole toward the one side, wherein at least a portion of the second rib part in a direction from the second curved hole to the other side is provided in a wavy shape.

* * * * *